US009897365B2

(12) United States Patent
Lee et al.

(10) Patent No.: US 9,897,365 B2
(45) Date of Patent: Feb. 20, 2018

(54) REFRIGERATOR, THERMOSYPHON, AND SOLENOID VALVE AND METHOD FOR CONTROLLING THE SAME

(71) Applicant: LG ELECTRONICS INC., Seoul (KR)

(72) Inventors: Sangbong Lee, Seoul (KR); Younghoon Yun, Seoul (KR); Chandra Sheker Gangwar, Seoul (KR); Taehee Lee, Seoul (KR); Sangoh Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 828 days.

(21) Appl. No.: 13/625,353

(22) Filed: Sep. 24, 2012

(65) Prior Publication Data

US 2013/0152621 A1 Jun. 20, 2013

(30) Foreign Application Priority Data

Dec. 14, 2011 (KR) ..... 10-2011-0134272
Dec. 14, 2011 (KR) ..... 10-2011-0134273
Feb. 24, 2012 (KR) ..... 10-2012-0018980

(51) Int. Cl.
*F25B 27/00* (2006.01)
*F25D 29/00* (2006.01)
(Continued)

(52) U.S. Cl.
CPC ..... *F25D 11/025* (2013.01); *F25D 17/02* (2013.01); *F25D 19/04* (2013.01); *F25B 27/00* (2013.01);
(Continued)

(58) Field of Classification Search
CPC ..... F25D 11/025; F25D 19/006; F25D 19/04; F25D 2700/40; F25D 29/00; F25D 17/02;
(Continued)

(56) References Cited

U.S. PATENT DOCUMENTS 3,933,198 A * 1/1976 Hara ..... F25D 11/025 165/104.13
4,015,442 A * 4/1977 Schumacher ..... F25D 23/02 62/449
(Continued)

FOREIGN PATENT DOCUMENTS

CN 1134537 A 10/1996
CN 1370262 A 9/2002
(Continued)

OTHER PUBLICATIONS

Chinese Office Action issued in Application No. 201210417044.5 dated Oct. 14, 2014. (Original Office Action and English Translation).
(Continued)

*Primary Examiner* — Frantz Jules
*Assistant Examiner* — Daniel C Comings
(74) *Attorney, Agent, or Firm* — Ked & Associates, LLP

(57) ABSTRACT

A refrigerator may include a body having a freezing chamber and a refrigeration chamber, a cooling circuit for cooling the freezing chamber and the refrigeration chamber, and a power source for supplying power to the cooling circuit. The refrigerator may further include a thermosyphon provided between the freezing chamber and refrigerating chamber. A control circuit may be connected to the thermosyphon to control a flow of refrigerant in the thermosyphon. The control circuit may include a valve provided on a circulation path of the thermosyphon, a electrical power storage device connected between the power source and the valve, and a
(Continued)

switching circuit provided between the valve and the electrical power storage device. When the power source does not supply power to the cooling circuit, the control circuit may operate the thermosyphon using power stored in the electrical power storage device.

25 Claims, 14 Drawing Sheets

(51) Int. Cl.
*F25D 11/02* (2006.01)
*F25D 17/02* (2006.01)
*F25D 19/04* (2006.01)
*F25D 19/00* (2006.01)

(52) U.S. Cl.
CPC ..... *F25B 2600/2515* (2013.01); *F25B 2600/2519* (2013.01); *F25B 2700/15* (2013.01); *F25D 19/006* (2013.01); *F25D 2400/40* (2013.01)

(58) Field of Classification Search
CPC .. F25B 27/00; F25B 2700/15; F25B 2600/25; F25B 2600/2515; F25B 2600/2519
USPC ..... 62/149, 441, 443, 267, 236
See application file for complete search history.

(56) References Cited

U.S. PATENT DOCUMENTS 4,796,436 A * 1/1989 Voorhis ..... F25B 45/00 62/149
4,840,037 A 6/1989 Yamada et al.
5,628,205 A * 5/1997 Rockenfeller ..... C09K 5/047 62/112
2004/0065111 A1 4/2004 Monfarad ..... 64/498
2005/0172644 A1 8/2005 Zhang et al. ..... 62/6
2009/0045680 A1* 2/2009 Litch ..... F25D 17/065 307/66
2009/0260371 A1* 10/2009 Kuehl ..... F25B 25/005 62/79

FOREIGN PATENT DOCUMENTS

CN 1646871 A 7/2005
CN 100513953 C 7/2009
EP 0189624 A2 * 8/1986 ..... B60H 1/20
EP 2 549 210 A2 1/2013
JP 07-253266 10/1995
JP H11-211313 A 8/1999
JP 3020728 B2 3/2000
JP 2002-246226 8/2002
JP 2005-249258 A 9/2005
JP 2006-138605 A 6/2006
KR 20040040719 A 5/2004

OTHER PUBLICATIONS

European Search Report dated Oct. 21, 2015 issued in Application No. 12187589.2.

Korean Office Action dated Dec. 14, 2017 issued in Application No. 10-2012-0018980 (English translation attached).

* cited by examiner

REFRIGERATOR, THERMOSYPHON, AND SOLENOID VALVE AND METHOD FOR CONTROLLING THE SAME

CROSS-REFERENCE TO RELATED APPLICATION(S)

This application claims the benefit of Korean Patent Application Nos. 10-2011-0134273, filed on Dec. 14, 2011; 10-2011-0134272, filed on Dec. 14, 2011 and 10-2012-0018980, filed on Feb. 24, 2012, whose entire disclosures are hereby incorporated by reference.

BACKGROUND

1. Field

A refrigerator, thermosyphon, and a solenoid valve for the thermosyphon and a method for controlling the same are disclosed herein.

2. Background

Refrigerators, thermosyphons, and solenoid valves for the thermosyphons and methods for controlling the same are known. However, they suffer from various disadvantages.

BRIEF DESCRIPTION OF THE DRAWINGS

The embodiments will be described in detail with reference to the following drawings in which like reference numerals refer to like elements, wherein.

DETAILED DESCRIPTION

Figure 1:
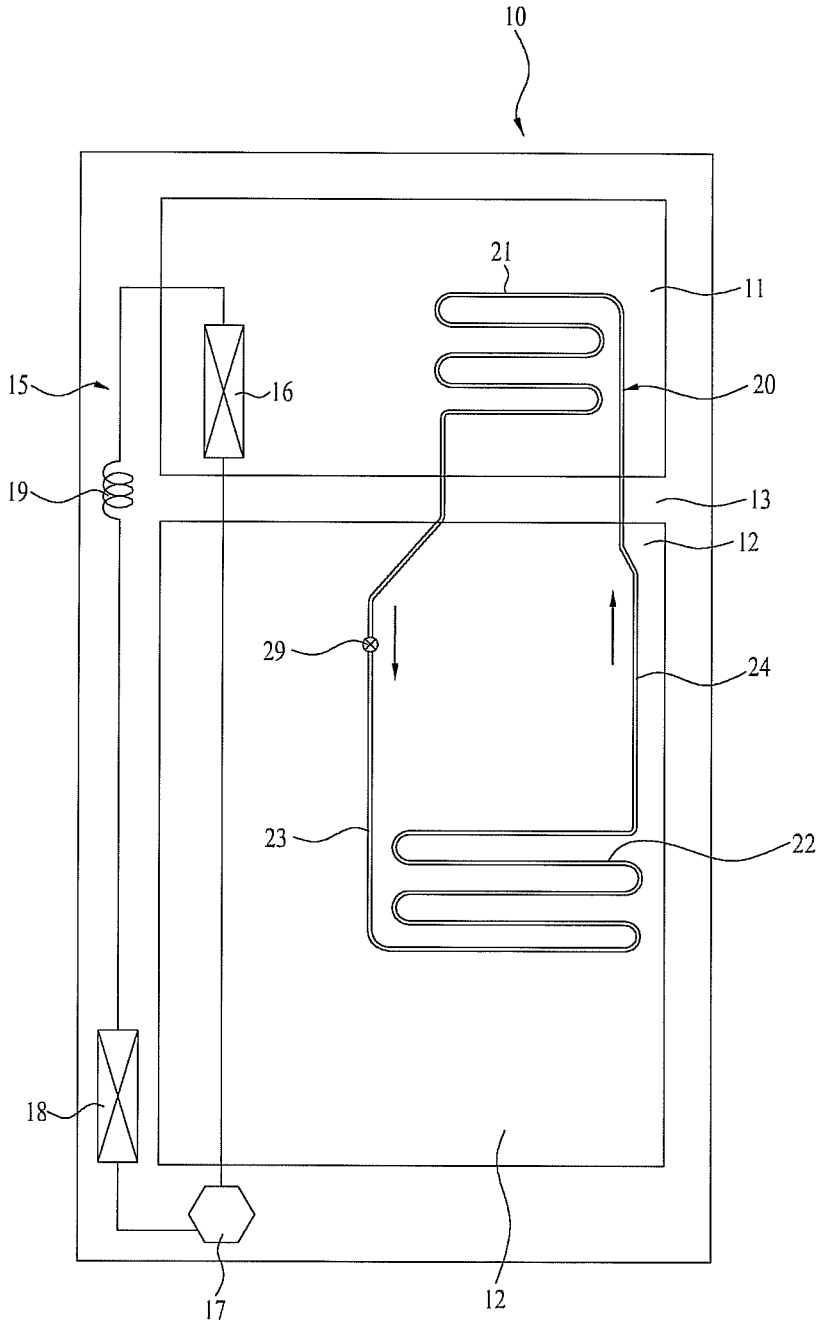
FIG. 1 is a conceptual view of a cooling cycle and a thermosyphon of a refrigerator.

In general, a refrigerator is an apparatus that keeps food, etc. at freezing or at a temperature slightly above freezing. To this end, the refrigerator contains hydraulic fluid that undergoes phase change at a specific temperature. As the hydraulic fluid is repeatedly vaporized and liquefied by absorbing heat within the refrigerator and emitting the absorbed heat to the outside, the interior of the refrigerator is cooled.

A refrigerator may be configured such that hydraulic fluid circulates through a cooling cycle (cooling circuit) that includes a compressor, condenser, expander, and evaporator, that operate to cool the interior of the refrigerator. The compressor may be located in a rear lower region of a refrigerator body. Also, the evaporator, in which the hydraulic fluid undergoes heat exchange with interior air of a freezing compartment, may be attached to a rear wall of the freezing compartment.

The refrigerator has no problem in operation while power is normally supplied and the compressor is operated normally because the interior temperature of the refrigerator is constantly maintained owing to continuous supply of cold air. However, if cooling stops due to problems of the cooling cycle, such as a breakdown of the compressor or a power outage, the interior temperature of the refrigerator may increase.

In particular, food stored in a refrigeration compartment may be more sensitive to temperature increases when compared to the freezing compartment, for example, during a power outage. Food and other perishables stored in the refrigeration compartment may be more susceptible to spoiling as temperatures rise above desired levels. Hence, there is a demand for techniques to prevent temperature increases in the refrigeration compartment when power is limited or unavailable, such as, for example, during power outages.

Accordingly, the present disclosure is directed to refrigerator, a thermosyphon, a solenoid valve for a thermosyphon, and a controller for the solenoid valve and methods for controlling the same that substantially obviates one or more problems due to limitations and disadvantages of the related art.

One object of the present disclosure is to provide a controller for a solenoid valve, which opens an orifice to allow movement of fluid through the solenoid valve when certain conditions occur (e.g., a power outage), and closes the orifice to prevent movement of the fluid during normal operation of the refrigerator.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

Hereinafter, a refrigerator, thermosyphon, a solenoid valve for the thermosyphon, and a controller for the solenoid valve and a method of controlling the same will be described in detail with reference to the attached drawings. The same or similar elements are denoted by the same reference numerals, and a repeated description will be omitted.

FIG. 1 is a conceptual view of a cooling cycle and a thermosyphon of a refrigerator. A refrigerator body 10 may accommodate a cooling cycle 15 and a thermosyphon 20 to cool the refrigerator.

The present disclosure may be combined with smart grid technology. A smart grid may be a power grid combined with Information Technology (IT), which allows bidirectional power information exchange between a power supplier and a consumer, thereby optimizing energy efficiency.

Meanwhile, in the present disclosure, a power outage in which external power is not supplied to the refrigerator and a situation in which a power rate is high may be equally recognized. For example, the refrigerator may be configured operate without external power during a power outage as well as periods when the cost of power (e.g., power rate) is high. That is, in the above described two cases, a thermosyphon may be operated without using external power supplied. Of course, the cooling cycle may operate instead of the thermosyphon when the power rate is relatively low.

In the present disclosure, the thermosyphon may be separated from the cooling cycle included in the refrigerator such that different refrigerants individually circulate in the thermosyphon and the cooling cycle, thereby serving to cool a refrigeration compartment using cold air of a freezing compartment. In this case, since the thermosyphon functions as an auxiliary device to the cooling cycle, the cooling cycle may be not operated if the thermosyphon is operated. Similarly, the thermosyphon may be operated if the cooling cycle is not operated. As previously described, examples of situations in which the cooling cycle is not in operation may include a power outage in which external electric power is not supplied, a breakdown or failure of the cooling cycle, or during periods in which the external electric power rate is high.

That the cooling cycle is not in operation may represent that the compressor, which is operated by externally supplied power, does not compress hydraulic fluid, and thus, circulation of the hydraulic fluid does not occur within the cooling cycle. Accordingly, the cooling cycle cannot function to supply cold air into the refrigerator.

Of course, even in the case in which external power is supplied, the compressor of the cooling cycle may not be operated, and thus, cold air may not be fed into the refrigeration compartment or the freezing compartment. In this case, the thermosyphon may be turned off. This is because the freezing compartment or the refrigeration compartment may be sufficiently cooled, and thus, does not need additional circulation of cold air.

Moreover, it should be appreciated that as the cooling cycle and the thermosyphon are separate cooling circuits having separate refrigerants, they may be operated independently. For example, it should be appreciated that the cooling cycle may be turned on when the thermosyphon is turned off, the cooing cycle may be turned off when the thermosyphon may be turned on, or both the cooling cycle and the thermosyphon may be turned on or off. In one embodiment, the operational states of the cooling cycle and the thermosyphon may be controlled based on prescribed energy modes, e.g., to conserve energy or to minimize costs, to maximize performance, or the like.

As described herein, the thermosyphon may provide auxiliary cooling when the cooling cycle is not operational. However, in certain cases, it may be desirable to continue operation of various components of the cooling cycle even during operation of the thermosyphon. For example, a fan included in the cooling cycle to circulate air in the storage chambers may be operated to enhance air circulation while the thermosyphon is operational. Accordingly, each component of the cooling cycle and the thermosyphon may be controlled individually based on the desired functions and availability.

The refrigerator body 10 may internally define a freezing compartment 11 and a refrigeration compartment 12 with a partition 13 interposed therebetween. The cooling cycle 15 may be accommodated in the refrigerator body 10 to cool the interior of the refrigerator body 10.

The cooling cycle 15 may be configured to artificially compress refrigerant using a compressor 17 and to liquefy the compressed refrigerator using a condenser 18. As the liquefied refrigerant is changed into gas phase refrigerant via expansion using an expander 19 and an evaporator 16, heat exchange occurs between the refrigerant and surroundings, causing temperature drop in the surroundings.

The evaporator 16 of the cooling cycle 15 may be mounted in the freezing compartment 11 to cool the freezing compartment 11. Cold air of the freezing compartment 11 may be used to maintain the refrigeration compartment 12 at a desired temperature. To ensure that the cooling cycle 15 continuously cools the interior of the refrigerator body 10, power must be applied to operate the compressor 17. Therefore, in case of power outage, when operation of the compressor 17 stops, temperature in the refrigerator body 10 increases.

To prepare for a situation in which the supply of power stops and the cooling cycle 15 cannot be operated, a thermal storage device capable of storing cold air, such as a phase change material (PCM), may be provided in the freezing compartment 11. In this way, it is possible to prevent temperature increases in the freezing compartment 11 using cold air previously stored in the material even while the cooling cycle 15 is not in operation.

However, in the case of the refrigeration compartment 12 which has a temperature greater than that of the freezing compartment 11, the effectiveness of a phase change material to manage increasing temperatures of the refrigeration compartment may be limited. For this reason, the thermosyphon 20 may be used to minimize temperature increases in the refrigeration compartment 12 using cold air of the freezing compartment 11.

The thermosyphon 20 is a device that transfers thermal energy using refrigerant that circulates based on convection without the need for a mechanical pump. The thermosyphon 20 may transfer thermal energy, for example, between a freezing compartment to a refrigeration compartment to cool the refrigeration compartment. In this example, the refrigerant may undergo phase change from a gas to a liquid at a specific temperature at the freezing compartment as it stores energy for generating cold air from the freezer compartment. The refrigerant in the liquid state may flow downward to the refrigeration compartment due to gravity. As the refrigerant cools the refrigeration compartment, it may change states from liquid to gas to circulate back up toward the freezer compartment. That is, the thermosyphon 20 is a device that performs movement of heat without requiring electric energy based on the phase change principle of the refrigerant.

As shown in FIG. 1, a portion of the thermosyphon 20 may be located in the refrigeration compartment 12 and the remaining portion may be located in the freezing compartment 11. The thermosyphon 20 may transfer heat using refrigerant circulating between the freezing compartment 11 and the refrigeration compartment 12. The thermosyphon 20 may include a condensing portion 21, evaporating portion 22, first connecting pipe 24, and second connecting pipe 23.

While the refrigerant is configured to flow in the above described direction, one of ordinary skill in the art would appreciate that some amounts of refrigerant may flow in the opposite direction (e.g., backflow). Moreover, it should be appreciated that the thermosyphon 20 including the condensing portion 21 and the evaporating portion 22 may be provided at (e.g., in, on or near) the freezing compartment 11 and the refrigeration compartment 12, respectively, and is not limited to being positioned inside the respective compartments. For example, the pipe that forms the condensing portion 21 may be provided on an outer surface of the freezing chamber, an inner surface of the freezing chamber, or between the inner and outer surface of the freezing chamber, etc. Moreover, to prevent or limit backflow of refrigerant, one or more backflow preventing members may be provided in the thermosyphon. The backflow preventing members may be formed by shaping the pipe in a prescribed shape such as, for example, a P-trap, or the like.

The refrigerant used in the thermosyphon 20 may have a vaporization temperature which may be equal to or less than the highest temperature of the refrigeration compartment 12 upon driving of the cooling cycle 15. The evaporating portion 22 of the thermosyphon 20 may be located in the refrigeration compartment 12, and may serve to change a liquid-phase refrigerant into a gas-phase refrigerant by absorbing heat of the refrigeration compartment 12. Accordingly, if the vaporization temperature of the refrigerant is less than the highest temperature of the refrigeration compartment 12, the refrigerant may be vaporized by absorbing heat of the refrigeration compartment 12 so long as the cooling cycle is normally operated.

Meanwhile, the vaporization temperature of the refrigerant used in the thermosyphon 20 may be less than or equal to an average temperature of the refrigeration compartment 12 in a preset specific mode upon driving of the cooling cycle 15. In this case, the refrigerant present in the evaporating portion 22 may be vaporized at a lower temperature than the temperature of the refrigeration compartment 12 in a specific mode that is set by a user or is set automatically (for example, a low-temperature refrigeration mode and a high-temperature refrigeration mode). Accordingly, the vaporization temperature of the refrigerant used in the thermosyphon 20 may be within a limited variation range.

In particular, the vaporization temperature of the refrigerant used in the thermosyphon 20 may be less than or equal to the lowest temperature of the refrigeration compartment 12 that is realized upon driving of the cooling cycle 15. To ensure efficient operation of the thermosyphon 20, the refrigeration compartment 12, heat of which is observed by the evaporating portion 22, may have a higher temperature than the evaporating portion 22. That is, under the above described temperature condition, vaporization of the refrigerant may occur at or below the lowest temperature of the refrigeration compartment 12, which may result in easier and more rapid vaporization of the refrigerant in the evaporating portion 22.

The condensing portion 21 may be located in the freezing compartment 11, in which the refrigerant absorbs cold air while being liquefied. The state of the refrigerant may change from a gas phase to a liquid phase in the condensing portion 21. The evaporating portion 22 may be located in the refrigeration compartment 12, in which vaporization of the refrigerant occurs to change the state of the refrigerant from liquid to gas. It should be appreciated, however, that while the refrigerant is disclosed herein as changing state in the condensing portion 21 and evaporating portion 22, not all of the refrigerant may change state and a certain amount of refrigerant may not change state between a gaseous state and a liquid state in the condensing portion 21 or the evaporating portion 22.

The first connecting pipe 24 may connect an exit of the evaporating portion 22 and an entrance of the condensing portion 21 to each other and may guide movement of the refrigerant from the evaporating portion 22 to the condensing portion 21. The second connecting pipe 23 may connect an exit of the condensing portion 21 and an entrance of the evaporating portion to each other and may guide movement of the refrigerant from the condensing portion 21 to the evaporating portion 22.

During normal operation of the refrigerator, the refrigerant within the thermosyphon 20 may be held stationary in the freezing compartment 11 to emit heat and preserve cold air. To this end, a valve 29 may be provided on a circulation path of the thermosyphon 20 to prevent circulation of the refrigerant. The valve 29 can effectively block the flow of refrigerant at any position on the thermosyphon 20.

The valve 29 may be used to close the second connecting pipe 23 when operation of the thermosyphon 20 stops. In this case, in addition to the valve 29, a separate valve may be provided to close the first connecting pipe 24 as well. That is, when the thermosyphon 20 is not in operation, it is possible to simultaneously close the first connecting pipe 24 and the second connecting pipe 23. For example, when closing both of the two connecting pipes 23 and 24 using the two valves, downward movement of the liquid-phase refrigerant through the second connecting pipe 23 may be limited, and simultaneously upward movement of the gas-phase refrigerant through the first connecting pipe 24 may be limited. Accordingly, providing the two valves may more rapidly and easily stop operation of the thermosyphon 20 than providing a single valve.

In the following description, it is assumed that the valve 29 is installed only at the second connecting pipe 23. As the valve 29 closes the second connecting pipe 23, the liquid-phase refrigerant is accumulated in an upper end of the second connecting pipe 23. Thereby, once the liquid-phase refrigerant of the thermosyphon 20 has been sufficiently accumulated in the second connecting pipe 23, circulation of the refrigerant stops, causing the thermosyphon 20 to be no longer operated.

That is, after a predetermined time has passed after closing a flow path of the second connecting pipe 23 using the valve 29, operation of the thermosyphon 20 may substantially stop.

After the predetermined time has passed after closing the second connecting pipe 23 using the valve 29, only air or the gas-phase refrigerant may fill the evaporating portion 22, or the liquid-phase refrigerant and the gas-phase refrigerant may coexist in the evaporating portion 22. For example, if the amount of the refrigerant injected into the thermosyphon 20 is relatively small, only air may be present in the evaporating portion 22 because all the refrigerant of the evaporating portion 22 may have vaporized and moved upward through the first connecting pipe 24.

Also, if the amount of the refrigerant injected into the thermosyphon 20 is within a medium range, a part of the gas-phase refrigerant present in the evaporating portion 22 may fail to move to the condensing portion 21 because the interior pressure of the thermosyphon 20 may increase due to the vaporized refrigerant in the evaporating portion 22. On the other hand, if the amount of the refrigerant injected into the thermosyphon 20 is relatively great, the interior pressure of the thermosyphon 20 may increase as a part of the liquid-phase refrigerant is vaporized in the evaporating portion 22, which may cause a part of the liquid-phase refrigerant present in the evaporating portion 22 to fail to be vaporized.

Since the thermosyphon 20 has a hermetically sealed interior space and the gas-phase refrigerant has a greater volume than the liquid-phase refrigerant having the same mass, the greater the amount of the gas-phase refrigerant, the greater the interior pressure of the thermosyphon 20. Also, the increased interior pressure may raise the vaporization temperature of the gas-phase refrigerant. If the interior pressure of the thermosyphon 20 excessively increases, a part of the liquid-phase refrigerant received in the evaporating portion 22 may fail to be vaporized.

To ensure that the liquefied refrigerant stays in the freezing compartment 11, as shown in FIG. 1, the valve 29 may be installed at the second connecting pipe 23.

Although the valve 29 may be mechanically operated using bimetal, or the like, an electronically operated solenoid valve 130 may be used to improve the reliability of the refrigerator. The solenoid valve 130 will be described in detail hereinafter with reference to the relevant drawings. The solenoid valve 130 may be electronically switched on and off to control a flow rate, and may include a moving core surrounded by a solenoid coil. When current is applied to the coil, a magnetic field is created. As the moving core is moved by the magnetic field to open or close the solenoid valve 130, it is possible to control a flow rate of the refrigerant.

The opening/closing operation of the solenoid valve 130 is possible only when power is available. Thus, although the valve can be closed when power is supplied, opening the valve when power supply stops, such as, for example, in case of a power outage, may be problematic. To constantly maintain the temperature of the refrigeration compartment 12 in case of power outage, the solenoid valve 130 must be opened to permit circulation of the refrigerant in the thermosyphon 20. The present disclosure provides a controller capable of supplying power to the solenoid valve 130 even in case of power outage.

Figure 2:
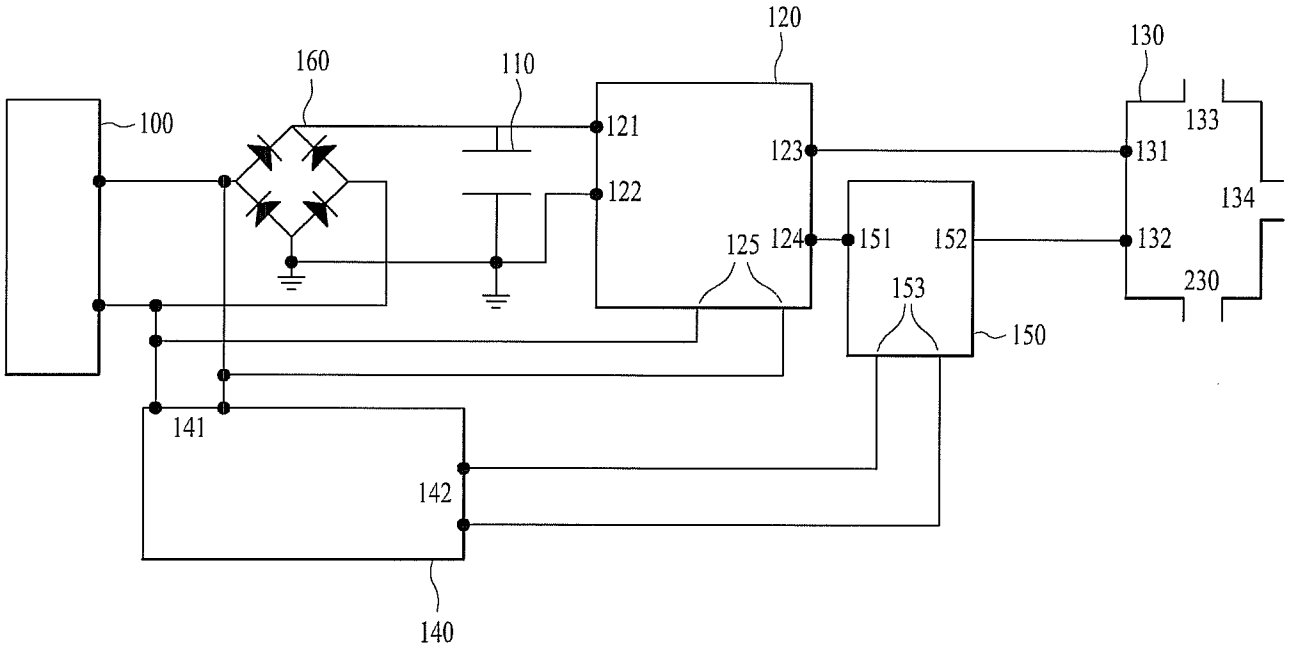
FIG. 2 is a circuit diagram of a controller for a solenoid valve according to an embodiment of the present disclosure.

FIG. 2 is a circuit diagram of a controller for the solenoid valve 130 according one embodiment. The controller may include a capacitor 110, power direction switching circuit 120, solenoid valve 130, time delay circuit 140, and power cutoff circuit 150.

The capacitor 110 may be a device that collects electric charge in a space between two conductive plates. A dielectric material is interposed between the two conductive plates, and electric charge is accumulated at boundaries between the surfaces of the respective conductive plates and the dielectric material. The greater the capacitance of the capacitor 110, the greater the amount of electric charge that can be accumulated. The capacitance of the capacitor 110, i.e., the amount of electric charge collected at the surfaces of the conductive plates, may be proportional to the size of the conductive plates and inversely proportional to a distance between the conductive plates.

The capacitor 110 may store an electric charge while external power is available, and then to supply required power by discharging the stored electric charge in case of power outage. The capacitor 110 has difficulty in storing sufficient energy required to operate the refrigerator, and increases in price as the capacitance thereof increases, resulting in increase in the price of the refrigerator. Therefore, a capacitance is preferably selected to supply a minimum energy required to operate essential components of the refrigerator.

In this case, since direct current (DC) must be supplied to the capacitor 110, rectification is necessary if external power is alternating current (AC). To this end, in the present disclosure a rectifier 160 is provided. The rectifier is a circuit device configured to permit flow of current only in a given direction using a diode, more particularly, to convert AC into DC. The rectifier 160 is not limited to the configuration shown in the drawing, and may be configured in various forms so long as it functions to convert AC to DC.

Figure 3:
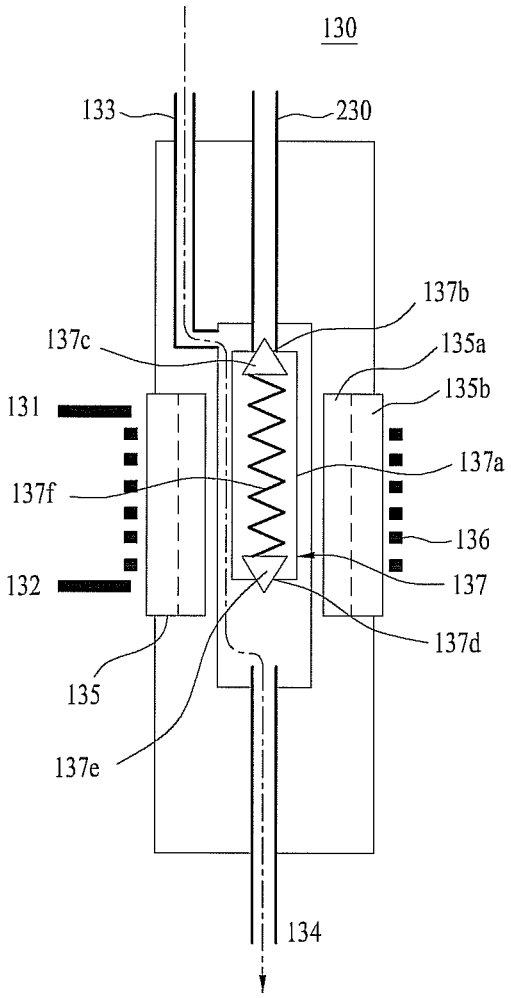
FIGS. 3 and 4 are diagrams of a solenoid valve.
Figure 4:
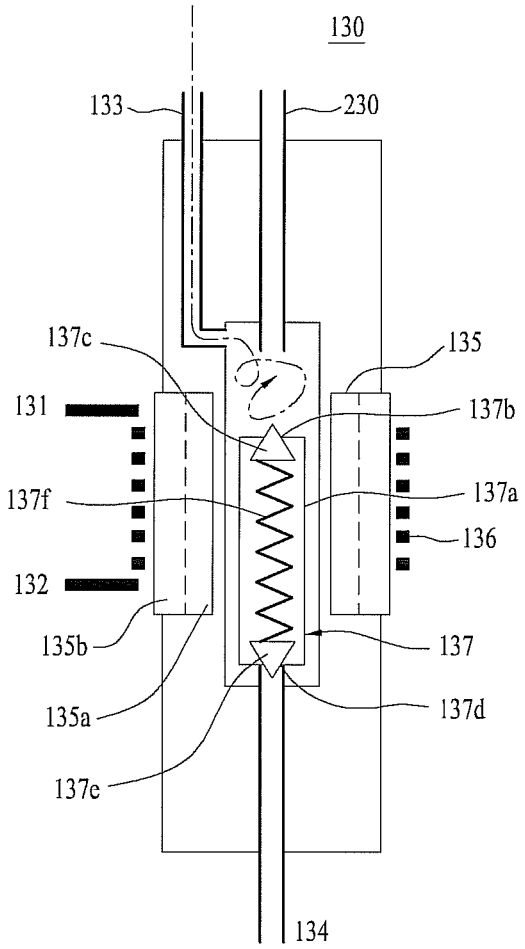

The solenoid valve 130 may include a solenoid coil 136 and a moving core 137 located inside the solenoid coil 136 (see FIGS. 3 and 4). If current is applied to the solenoid coil 136, a magnetic field is created. As the moving core 137 is moved by the magnetic field to open or close the electronic valve 130, the flow rate of the refrigerant may be controlled. Moreover, although the solenoid valve 130 may be a 2-way valve that simply opens or closes an orifice in a given direction, a 3-way valve may be used to regulate the flow of fluid in several directions.

As described above, the solenoid valve 130 is operable only while power is applied. In general, the solenoid valve 130 is held open or closed while power is applied. Then, if power is not applied and holding force disappears, the solenoid valve 130 is inversely changed into a closed or open state. In consideration of the fact that the solenoid valve 130 requires continuous application of power to hold a specific state, the solenoid valve 130 is suitable for an apparatus in which a non-application state of power is continued for a relatively long time.

For example, when a valve is required to be open for only a short period of time, a valve that defaults to the closed position may be used such that power is required only for a short period of time to hold the valve open. On the contrary, when a valve is required to be closed for only a short period of time, a valve that defaults to the open position may be used such that power is required only for a short period of time to close the valve. In the case of closing a valve, which is usually held open, only for a short time, a valve that requires power for closure may be used.

In the present disclosure, since the thermosyphon 20 is used only in case of power outage, the solenoid valve 130 may default in the closed position to close an orifice, and open the orifice only in case of a power outage. However, a solenoid valve 130 that defaults in the closed position may require a continuous supply of power during normal operation of the refrigerator, unnecessarily increasing energy consumption.

Accordingly, in the present disclosure, the solenoid valve 130 may be a latch valve type in which power is applied only to change the closed or open state of the valve, and the valve is held closed or open by, for example, a permanent magnet when power is not applied. FIGS. 3 and 4 show the solenoid valve 130 of the latch valve type. The shown solenoid valve 130 exhibits low power consumption and does not require continuous application of power thereto, and thus is not susceptible to overheating.

FIG. 3 is a diagram of a solenoid valve according to the present disclosure. Hereinafter, a configuration of the solenoid valve 130 will be described with reference to FIG. 3 in which the solenoid valve 130 is in a state to open an orifice to permit movement of fluid. That is, the solenoid valve 130 is in a state to allow operation of the thermosyphon 20, for example, in the event of a power outage.

The solenoid valve 130 may include a fluid inlet port 133, a fluid outlet port 134, a solenoid coil 136, power input terminals 131 and 132, a moving core 137, and a magnet 135 placed around the moving core 137. The entire body of the electronic valve 130 may be formed of a ferromagnetic material.

The solenoid valve 130 may further include an injection pipe 230, through which fluid can be injected from an external source. In this case, the injection pipe 230 may be used to initially inject fluid into the thermosyphon 20 for operating the thermosyphon 20. The inlet port 133 and the injection pipe 230 may be formed at the same side of the solenoid valve 130, and the outlet port 134 may be formed at the other side of the solenoid valve 130.

To operate the thermosyphon 20, it is necessary to circulate fluid within the thermosyphon 20 without a risk of leakage. Accordingly, it may not be preferable to provide a circulation path of the thermosyphon 20 with a fluid injection port for injecting fluid into the first connecting pipe 24, second connecting pipe 23, condensing portion 21 and evaporating portion 22. To this end, in the present disclosure, the injection pipe 230, which is separate from the inlet port 133 and the outlet port 134, may be provided at one side of the solenoid valve 130. Meanwhile, the injection pipe 230 may be sealed after a sufficient amount of fluid required in the thermosyphon 20 is initially injected.

In contrast to the configured as described above, the injection pipe 230 may communicate with the second connecting pipe 23 or the condensing portion 21. In this case, the injection pipe 230 may be connected to an upper position of the second connecting pipe 23, or may be connected to a specific position of the condensing portion 21 where cold air is accumulated in a state in which the solenoid valve 130 closes an orifice, e.g., while the thermosyphon 20 is not in operation.

The moving core 137 includes a case 137*a* formed of a ferromagnetic material. The case 137*a* may selectively open or close the orifice of the solenoid valve 130 by moving in a space defined in the solenoid valve 130.

A first through-hole 137*b* and a second through-hole 137*d* may be formed at both ends of the case 137*a*. In this case, a first protruding piece 137*c* is movably inserted into the first through-hole 137*b*, and a second protruding piece 137*e* is movably inserted into the second through-hole 137*d*. In this case, the first protruding piece 137*c* and the second protruding piece 137*e* may be opposite to each other.

In this case, the first protruding piece 137*c* may serve to seal the injection pipe 230, and the second protruding piece 137*e* may serve to seal the outlet port 134. The first and second protruding pieces 137*c*, 137*e* may be a stopper, seal, plug, or the like, having a prescribed shape to block the flow of fluid in through the valve 130. The first protruding piece 137*c* and the second protruding piece 137*e* may have an angulated tapered end. Thus, the injection pipe 230 or the outlet port 134 may be sealed as the angulated tapered ends of the first and second protruding pieces 137*c* and 137*e* are tightly inserted therein.

The first protruding piece 137*c* and the second protruding piece 137*e* may be formed of a deformable material, such as rubber, silicone or the like. This may serve to ensure stable control of the orifice by the solenoid valve 130 even if the protruding pieces 137*c* and 137*e* are worn after extended use.

An elastic member 137*f* may be accommodated in the case 137*a* to elastically support the first protruding piece 137*c* and the second protruding piece 137*e* at both ends of the case 137*a*. The elastic member 137*f* may be a coil spring, or the like. One end of the elastic member 137*f* may be secured to the first protruding piece 137*c*, and the other end may be secured to the second protruding piece 137*e*, so as to elastically support the first and second protruding pieces 137*c* and 137*e*. Therefore, even if the first protruding piece 137*c* and the second protruding piece 137*e* are worn, stable control of the orifice can be accomplished to stop the flow of refrigerant.

Meanwhile, the first through-hole 137*b* and the second through-hole 137*d* may have a tapered shape to guide movement paths of the first protruding piece 137*c* and the second protruding piece 137*e*. In this case, the first through-hole 137*b* may be tapered upward, and the second through-hole 137*d* may be tapered downward, as shown.

In case of a power outage, fluid introduced through the inlet port 133 may move downward to the outlet port 134. In this case, the inlet port 133 may be connected to the freezing compartment 11 and the outlet port 134 may be connected to the refrigeration compartment 12 to construct the thermosyphon 20.

If electric power is supplied to the solenoid coil 136, a magnetic field is created, a direction of the magnetic field being changed based on the direction of power supplied to the solenoid coil 136. Magnetic force generated by the solenoid coil 136 is stronger than magnetic force generated by the permanent magnet 135, thereby serving to move the moving core 137.

The moving core 137 may be externally formed of a ferromagnetic material, and thus may be magnetized by a magnetic field around the moving core 137. As illustrated in FIG. 3, if a positive charge is applied to the first power input part 131 and negative charge is applied to the second power input part 132, the moving core 137 is moved upward upon receiving upward force. The upwardly moved moving core 137 opens the fluid outlet port 134, causing the fluid introduced through the fluid inlet port 133 to be discharged through the fluid outlet port 134. In this way, the solenoid valve 130 may be opened.

The permanent magnet 135 has a feature that an inner side 135*a* and an outer side 135*b* have different polarities. Even if power is cut off, the moving core 137 may be held to open the outlet port 134 by magnetic force of the permanent magnet 135 placed around the moving core 137.

In this case, as the moving core 137 is moved upward, the injection pipe 230 may be closed by the first protruding piece 137*c*. Of course, if the injection pipe 230 has already been sealed after initial injection of fluid, the first protruding piece 137*c* may serve to further tighten the sealing of the injection pipe 230.

On the other hand, if the injection pipe 230 is connected to an upper position of the second connecting pipe 23 or to a specific position of the condensing portion 21, the injection pipe 230 may be sealed in order to achieve circulation of fluid through the thermosyphon.

FIG. 4 is a diagram of the solenoid valve of FIG. 3 in a closed state. If current is applied to the power input parts 131 and 132 in an opposite polarity to that as described with reference to FIG. 3, a magnetic field in an opposite direction to that in FIG. 3 is created, causing the moving core 137 to move downward to thereby close the outlet port 134. That is, FIG. 4 illustrates a state in which power is normally supplied to the refrigerator, and thus operation of the thermosyphon is unnecessary.

In the closed state of the solenoid valve 130, the moving core 137 may be magnetized in an opposite direction to that in FIG. 3. Thus, the solenoid valve 130 is able to be held closed by the permanent magnet 135 even if power is not applied to the solenoid coil 136.

In this case, if the injection pipe 230 has been closed (sealed) after initial injection of fluid, the fluid may be stationary, rather than moving through the injection pipe 230. On the other hand, if the injection pipe 230 is connected to the second connecting pipe 23 or the condensing portion 21, fluid can move through the injection pipe 230. Even in this case, the fluid does not circulate throughout the thermosyphon, which allows cold air to be accumulated in the condensing portion 21.

Figure 5:
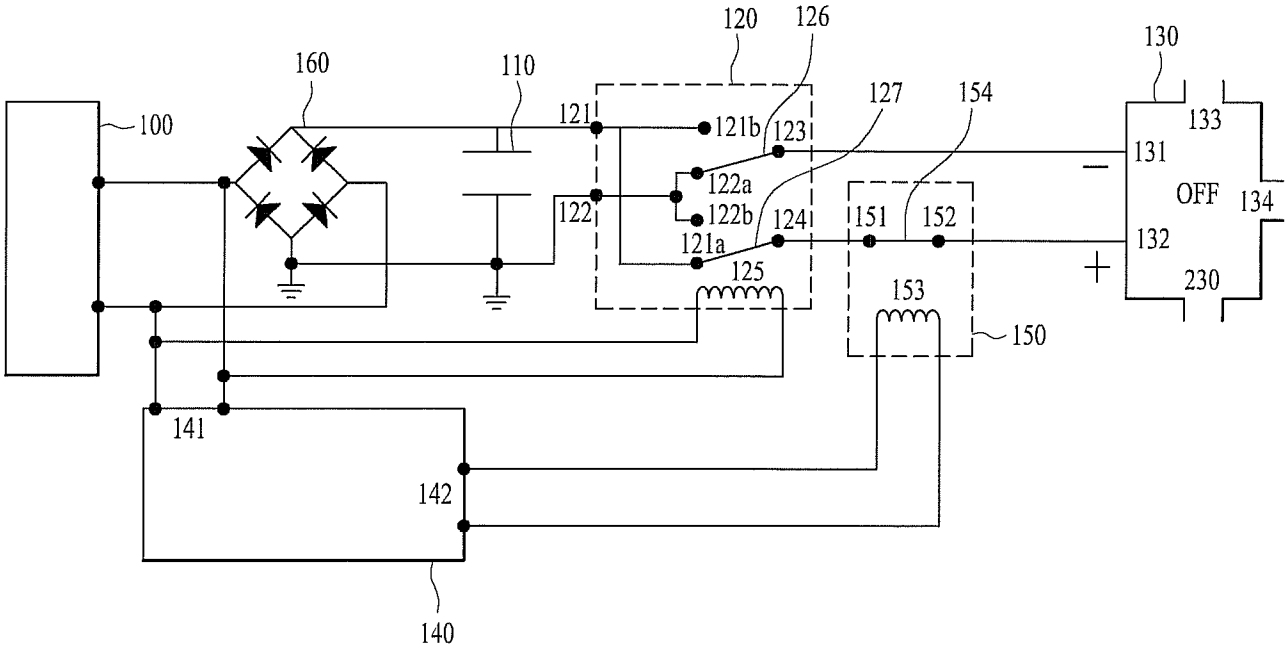
FIGS. 5 to 7 are circuit diagrams that illustrate an operation of a controller for a solenoid valve according to an embodiment of the present disclosure.
Figure 6:
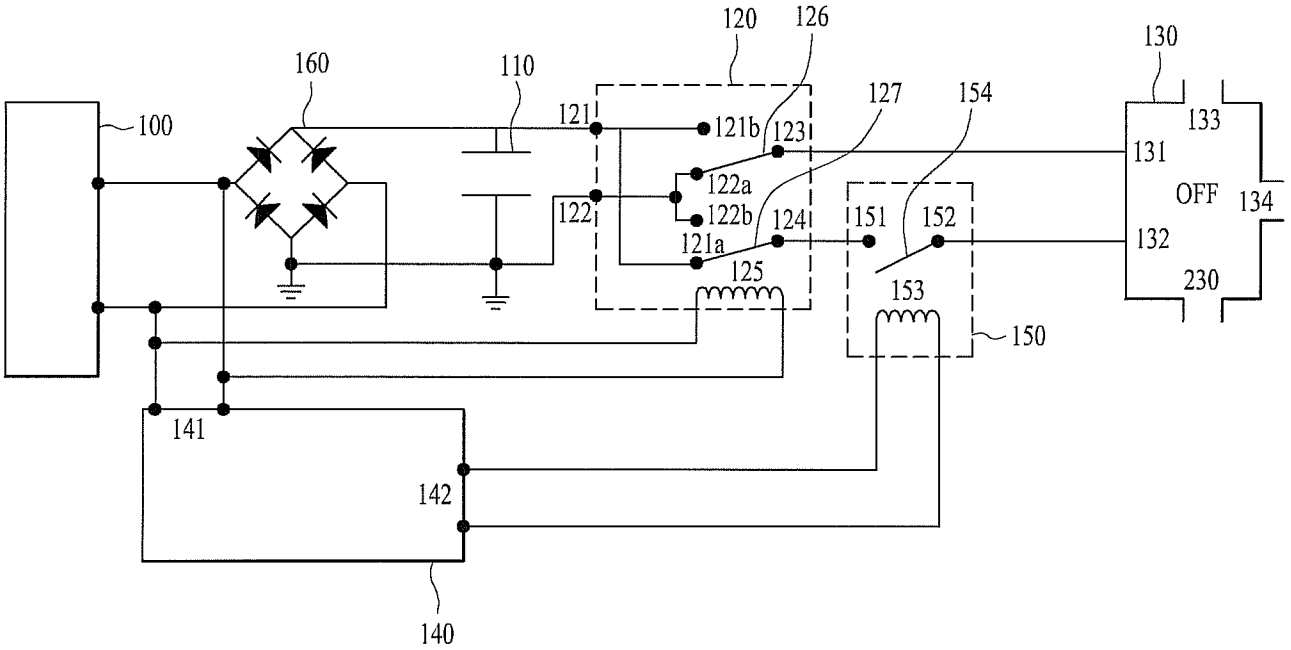
Figure 7:
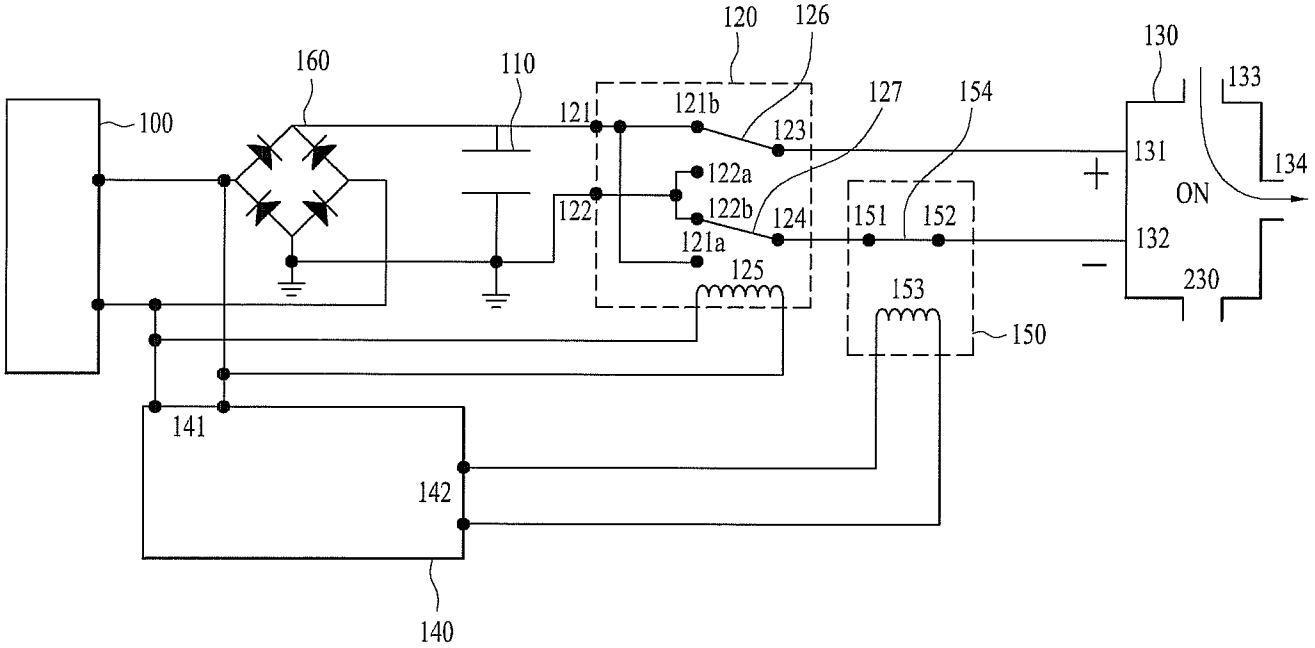

As described above, the solenoid valve 130 of the present disclosure may be opened or closed based on a polarity of the voltage applied to the power input terminals 131 and 132. As illustrated in FIG. 5, when a negative voltage is applied across the input terminals 131 and 132 (e.g., a negative charge is input to the first power input part 131 and positive charge is input to the second power input part 132), the solenoid valve 130 may be placed in a closed state. On the contrary, as illustrated in FIG. 7, if a positive voltage is applied across the input terminals 131 and 132 (i.e., a positive charge is input to the first power input part 131 and negative charge is input to the second power input part 132), the solenoid valve 130 may be placed in an opened state. FIG. 6 illustrates a state in which power is not applied after the solenoid valve 130 has been closed. The solenoid valve 130 is held closed so long as power is not applied.

To open or close the solenoid valve 130, it is necessary to change the direction of power (polarity) to be input to the first power input part 131 and the second power input part 132. The power direction switching circuit 120 may be located between an external power supply unit 100 and the solenoid valve 130 and may serve to change the direction of power to be input to the solenoid valve 130.

The power direction switching circuit 120 may receive external power supplied to the refrigerator or power discharged from the capacitor 110 and output the power in a first direction or a second direction (polarity). If a signal (control signal) that commands output of power in the first direction or the second direction is input to the power direction switching circuit 120, a connection mode of the power direction switching circuit 120 is changed in response to the signal, causing the direction of current to be changed.

The power direction switching circuit 120 may include a relay, which changes a circuit connection mode using an electromagnet to control flow of current. In the present disclosure, as shown in FIG. 2, the power direction switching circuit 120 may include a pair of terminals 121 and 122 connected to the external power supply unit 100 or the capacitor 110, a pair of terminals 123 and 124 connected to the solenoid valve 130, and a signal input part 125. Based on whether or not a signal is input to the signal input part 125, the direction of power output from the power direction switching circuit 120 may be changed into a first direction or a second direction.

FIGS. 5 to 7 show an embodiment of the power direction switching circuit 120 according to the present disclosure. In the present embodiment, power is applied such that the first terminal 121 is positive and the second terminal 122 is negative, the first direction refers to a power output direction in which the third terminal 123 is negative and the fourth terminal 124 is positive, and the second direction refers to a power output direction in which the third terminal 123 is positive and the fourth terminal 124 is negative.

The first direction and the second direction may be inversely determined based on the connection mode of the solenoid valve 130.

The power direction switching circuit 120 of the present disclosure may allow current to flow in the first direction if a signal is input to the signal input part 125, and may allow current to flow in the second direction if no signal is input. FIG. 5 shows the power direction switching circuit 120 in a state in which the current is configured to flow in the first direction, and FIG. 7 shows the power direction switching circuit 120 in a state in which current is configured to flow in the second direction.

More specifically, FIG. 5 shows an operating state when external power begins to be supplied. If external power is supplied to the refrigerator, the external power is input through the first terminal 121 and the second terminal 122. In this case, the external power is AC, the external power is changed into DC by the rectifier 160 prior to being input to the first and second terminals 121 and 122.

The signal input part 125 may receive an input signal that moves switches 126 and 127. The signal input part 125 may include a coil. That power is applied to the signal input part 125 may mean that a signal is input to the signal input part 125. Thus, if a signal is input to the signal input part 125, a magnetic field may be generated by current flowing through the coil, causing the switches 126 and 127 to be moved.

The signal input part 125 may be connected to the external power supply unit 100 and recognizes the external power as a signal. That is, if external power is supplied to the refrigerator, the external power is applied to the signal input part 125 such that current flows through the coil of the signal input part 125, which changes a connection mode of the switches 126 and 127, as illustrated in FIG. 5. In FIG. 5, the first terminal 121 and the fourth terminal 124 are connected to each other, and the second terminal 122 and the third terminal 123 are connected to each other, e.g., reversing the polarity of the rectified external voltage supplied to the solenoid valve 130 to close the solenoid valve 130.

Accordingly, in the case in which external power is supplied, since the first terminal 121 is positive, the second terminal 122 is negative, and a signal is input to the signal input part 125, the power is input to the power direction switching circuit 120 such that the third terminal 123 is negative and the fourth terminal 124 is positive. That is, the current flows in the first direction, e.g., the polarity of the voltage input at the power direction circuit 120 is reversed for output to the solenoid valve 130. The power may be applied to the solenoid valve 130 such that the first power input part 131 is negative and the second power input part 132 is positive, thereby controlling the solenoid valve 130 to be in a closed state to stop the flow of refrigerant.

FIG. 7 is a view illustrating an operation of a controller for the solenoid valve 130 while external power is not supplied, e.g., during a power outage. Since external power is not supplied, electric charge stored in the capacitor 110 is discharged so as to be supplied to the power direction switching circuit 120.

Since no external power is supplied to the signal input part 125 connected to the external power supply unit 100, no signal is input to the signal input part 125. Thus, as illustrated in FIG. 7, the switches 126 and 127 are moved to connect the first terminal 121*b* and the third terminal 123 to each other and the second terminal 122*b* and the fourth terminal 124 to each other.

The power is input to the power direction switching circuit 120 by the capacitor 110 in a direction such that, since the first terminal 121 is positive and the second terminal 122 is negative, the third terminal 123 is positive and the fourth terminal 124 is negative (the second direction of current flow). That is, the polarity of the voltage from the capacitor is not reversed by the power direction circuit 120 such that the power is applied to the solenoid valve 130 in an opposite direction (polarity) to that of FIG. 5. Thus, the first power input terminal 131 of the solenoid valve 130 is positive and the second power input terminal 132 is negative, thereby controlling the solenoid valve 130 to be in an opened state to allow the flow of refrigerant, as illustrated in FIG. 7.

Since continuously supplying power to the solenoid valve 130 may cause emission of heat from the solenoid valve 130, it may be necessary to interrupt power such that power is no longer supplied after the state of solenoid valve 130 has been changed. Interrupting power may prevent overheating of the solenoid valve 130 and excessive power consumption.

In one embodiment, a power application device may be provided to control whether or not power will be applied to the solenoid valve 130. The power application device may comprise the power cutoff circuit 150 and the time delay circuit 140.

The power cutoff circuit 150 may disconnect an electrical connection between the power direction circuit 120 and the second input terminal 132 of the solenoid valve 130 to interrupt power supplied to the solenoid valve 130. The power cutoff circuit 150 may be located at any position between the external power supply unit 100 and the solenoid valve 130 or between the external power supply unit 100 and the power direction switching circuit 120. Alternatively, as shown in FIG. 2, the power cutoff circuit 150 may be interposed between the power direction switching circuit 120 and the solenoid valve 130. Hereinafter, for convenience of description, the case in which the power cutoff circuit 150 is interposed between the power direction switching circuit 120 and the solenoid valve 130 will be described, but the present disclosure is not limited thereto.

The power direction switching circuit 120 and the solenoid valve 130 may be connected to each other or disconnected from each other. This connection or disconnection of the power direction switching circuit 120 may be determined based on whether or not a signal (control signal) is input to a signal input part 153 of the power cut-off circuit 150.

If a signal is input to the signal input part 153, the power cutoff circuit 150 may be switched on to disconnect the first terminal 151 and the second terminal 152 from each other. That is, the switch 154 may be opened thereby disconnecting the power direction switching circuit 120 and the solenoid valve 130 from each other. This state of the power cutoff circuit 150 is illustrated in FIG. 6.

If no signal is input to the signal input part 153, the power cutoff circuit 150 may be switched off to connect the first terminal 151 and the second terminal 152 to each other. That is, the switch 154 may be closed thereby connecting the power direction switching circuit 120 and the solenoid valve 130 to each other. This state of the power cutoff circuit 150 is illustrated in FIG. 7.

The time delay circuit 140 may generate the signal input for the signal input part 153 corresponding to the state of the external power from the external power supply unit 100. The time delay circuit 140 may generate the signal input to control the switch 154 a predetermined period of time after receiving a corresponding signal from the external power supply unit 100. For example, the time delay circuit 140 may sense that external power is available from the external power unit 100 and generate a control signal after a predetermined amount of time, thereby relaying the external power to the signal input part 153 to open the switch 154 (e.g., switch on the power cutoff circuit 150). The delayed time may be a period of time sufficient to complete the opening/closing operation of the solenoid valve 130 and may be set to a range of 0.1 to 5 seconds.

That is, when external power begins to be supplied as illustrated in FIG. 5, a signal is not yet input to the signal input part 153 of the power cutoff circuit 150 by the time delay circuit 140. Thus, the power direction switching circuit 120 and the solenoid valve 130 may be electrically connected to each other by the power cutoff circuit 150. As previously described, the presence of external power may cause the power direction circuit 120 to reverse the polarity of the external power (first direction of current flow) in order to close the solenoid valve 130 and stop the flow of refrigerant through the solenoid valve 130.

After a predetermined amount of time has passed (e.g., sufficient amount of time for the solenoid valve to fully close), the power may be output from the time delay circuit 140 to produce the control signal at the signal input part 153 of the power cutoff circuit 150. Thereby, as illustrated in FIG. 6, the switch 154 of the power cutoff circuit 150 may be opened to disconnect the power direction switching circuit 120 and the solenoid valve 130 from each other (i.e., switch on the power cutoff circuit 150). In this way, after a predetermined amount of time has passed after the solenoid valve 130 has been closed, power is no longer applied to the solenoid valve 130 to prevent emission of heat from the solenoid valve 130 as well as to prevent wasted energy.

If external power is not supplied as illustrated in FIG. 7, the time delay circuit 140 no longer applies a control signal to the signal input part 153 of the power cutoff circuit 150, causing the switch 154 of the power cutoff circuit 150 to be closed. Thereby, as the power direction switching circuit 120 and the solenoid valve 130 are connected to each other, power may be supplied to the solenoid valve 130, and consequently the solenoid valve 130 is opened.

Figure 8:
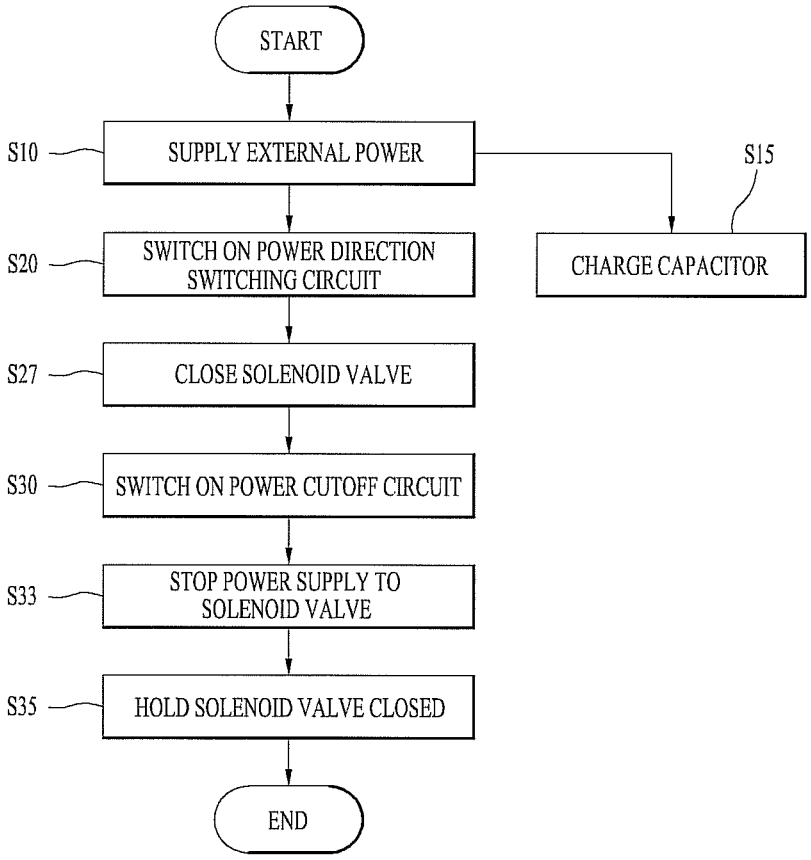
FIGS. 8 and 9 are flowcharts of a method of controlling a solenoid valve according to one embodiment of the present disclosure.
Figure 9:
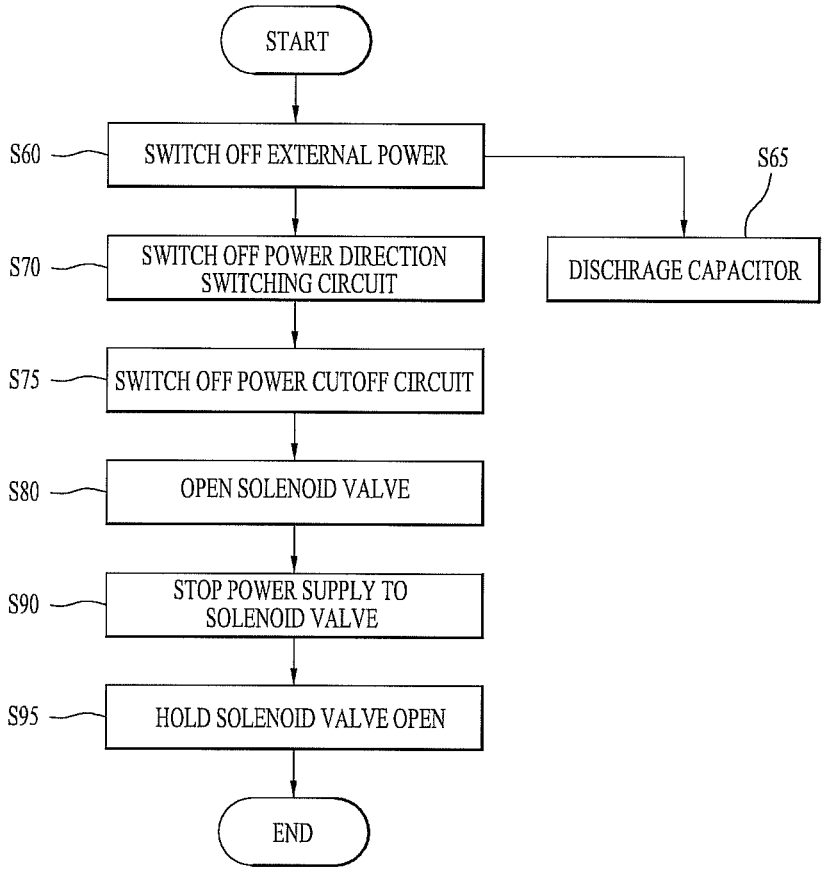

FIG. 8 is a flowchart of a method of controlling the solenoid valve 130 according to the present disclosure when external power is supplied, and FIG. 9 is a flowchart of a method of controlling the solenoid valve 130 according to the present disclosure when external power is not supplied.

First, how the solenoid valve 130 is controlled when external power is supplied will be described. If external power is supplied (S10), the capacitor 110 is charged with the external power (S15), and the external power is also rectified and applied to the power direction switching circuit 120. The power direction switching circuit 120 is switched on to reverse polarity of the applied external power for relay to the solenoid valve (S20). Through application of the external power, a signal is input to the signal input part 125 of the power direction switching circuit 120. Thereby, as shown in FIG. 5, a first terminal 121*a* and the fourth terminal 124 of the power direction switching circuit 120 may be connected to each other and a second terminal 122*a* and the third terminal 123 may be connected to each other. Thus, the third terminal 123 and the second terminal 122*a* have the same negative potential, and the fourth terminal 124 and the first terminal 121*a* have the same positive potential.

As the polarity of the external voltage is reversed prior to being applied to the solenoid valve 130, e.g., as a negative charge is input to the first power input part 131 and a positive charge is input to the second power input part 132, the solenoid valve 130 may be closed (S27).

Also, the supplied external power may be applied to the time delay circuit 140, and the time delay circuit 140 may output the power after a predetermined time has passed. Although the above described circuit has no difference from a general circuit while external power is continuously supplied, the time delay circuit 140 causes external power to be supplied to the solenoid valve 130 after a predetermined time delay as compared to the case in which the external power supply unit is directly connected to the solenoid valve 130. The delayed time may be set such that it is sufficient to complete the opening/closing operation of the solenoid valve 130 and may be set to a range of 0.1 to 5 seconds.

The time delay circuit 140 is connected to the signal input part 153 of the power cutoff circuit 150, such that a signal may be input to switch on the power cutoff circuit 150 after a predetermined time has passed (S30).

FIG. 5 shows a state immediately after external power is input before the power is applied to the signal input part 153 of the power cutoff circuit 150. In a sate in which no power is applied to the signal input part 153, the first terminal 151 and the second terminal 152 of the power cutoff circuit 150 are connected to each other.

FIG. 6 shows a state in which a predetermined time has passed after external power is input. The external power passes through the time delay circuit 140 to thereby be applied to the signal input part 153 of the power cutoff circuit 150 in order to switch on the power cutoff circuit 150 (S30). The switch 154 of the power cutoff circuit 150 may be opened to disconnect the first terminal 151 and the second terminal 152 from each other.

That is, after a predetermined time has passed, as shown in FIG. 6, the power direction switching circuit 120 and the solenoid valve 130 are disconnected from each other, and power is no longer supplied to the solenoid valve 130 (S33). If supply of power to the solenoid valve 130 stops, the solenoid valve 130 may be held closed or open by the magnet 135. Thereby, the solenoid valve 130, which has been closed in operation S25, may be held closed (S35).

Next, referring to FIG. 9, the control method of the solenoid valve 130 when external power is not supplied, e.g., in case of a power outage, will be described. First, if supply of external power is cut off (S60), no power is supplied to the capacitor 110, causing the capacitor 110 to discharge electric charge stored therein (S65). That is, the capacitor 110 serves as a new power supply source, and power is supplied to the first terminal 121 and the second terminal 122 of the power direction switching circuit 120 in a direction such that the first terminal 121 is positive and the second terminal 122 is negative, in the same manner as the case in which external power is input.

However, since the capacitor 110 has a limited capacitance, the capacitor 110 supplies only energy required to open the solenoid valve 130. After the stored electric charge is completely discharged, the capacitor 110 no longer supplies power.

If external power is no longer supplied, a signal is not input to the signal input part 125 of the power direction switching circuit 120, switching off the power direction switching circuit (S70). The switches 126 and 127 of the power direction switching circuit 120 may be moved from the state shown in FIG. 6 to the state shown in FIG. 7 such that a first terminal 121*b* and the third terminal 123 are connected to each other and a second terminal 122*b* and the fourth terminal 124 are connected to each other. In other words, the power direction switching circuit 120 may be switched off such that the polarity of the input voltage is not reversed by the power direction switching circuit 120.

The power cutoff circuit 150 is switched off (S75). A control signal is not applied to the signal input part 153 of the power cutoff circuit 150 when external power is not available. When the control signal is not applied, the switch 154 may be closed to electrically connect the capacitor 110 to the solenoid valve 130. Here, the switch 154 may default to a closed state when no control signal is applied to the signal input part 153 and switch to an open state when a control signal is applied (e.g., when external power is available).

The solenoid valve 130 may be opened using the capacitor voltage applied at terminals 131 and 132 (S80). Moreover, since the capacitor 110 has a limited capacitance, after the charge stored in the capacitor 110 is completely discharged, power is no longer supplied to the solenoid valve 130 (S90), and the solenoid valve 130 is held open (S95) by the magnet 135.

In this embodiment, it may be unnecessary to open the solenoid valve 130 as soon as power outage occurs, and even if the solenoid valve 130 is opened after a predetermined time delay in case of power outage, this has no great effect on the maintenance of temperature within the refrigerator. Moreover, the capacitance of the capacitor 110 used in the present disclosure may be determined in consideration of the discharge time of the capacitor 110 and the amount of time required for the solenoid valve 130 to switch from a closed state to an open state.

Figure 10:
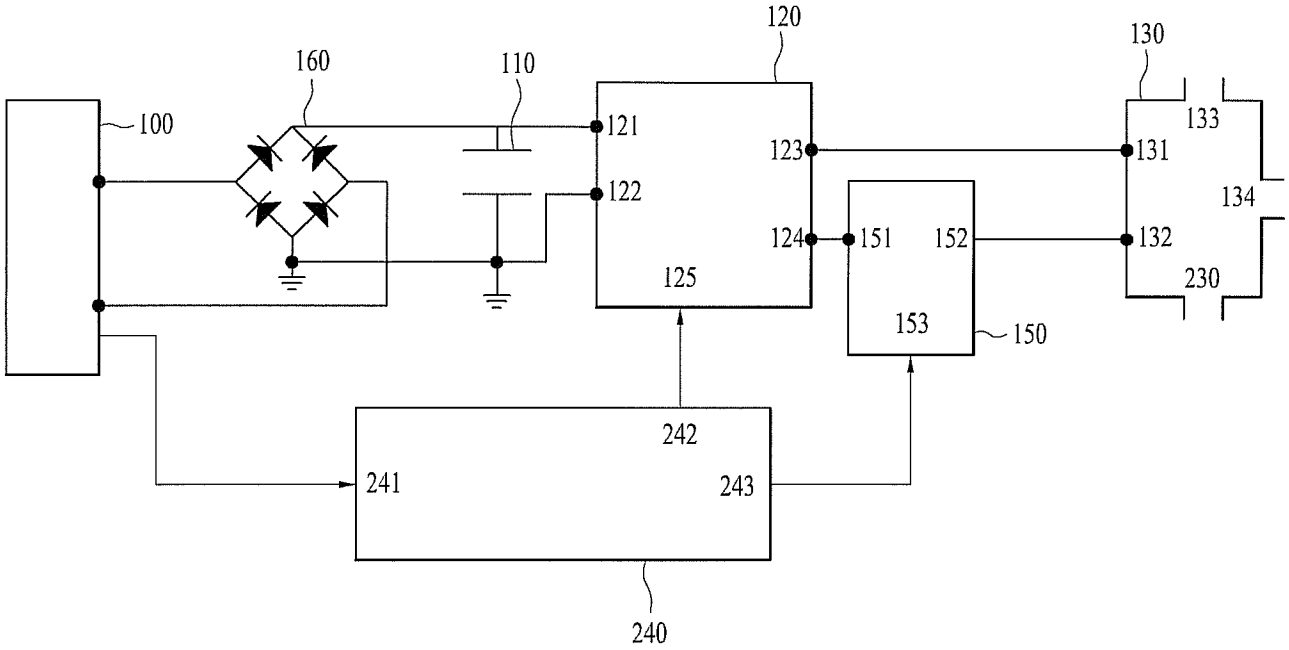
FIG. 10 is a circuit diagram of a controller for a solenoid valve according to one embodiment of the present disclosure.

FIG. 10 is a view of a controller for a solenoid valve according to another embodiment of the present disclosure. The controller for the solenoid valve 130 may include the capacitor 110, power direction switching circuit 120, solenoid valve 130, microcomputer 240, and power cutoff circuit 150.

As described above, the solenoid valve 130 may be operable only when power is applied thereto. In general, the solenoid valve 130 may be held open or closed while power is input, and then may be inversely changed into a closed or open state if power is not applied and holding force disappears. In consideration of the fact that the solenoid valve 130 requires continuous application of power to hold a specific state, the solenoid valve 130 may be suitable for an apparatus in which a non-application state of power is continued for a relatively long time.

If electric power is supplied to the solenoid coil 136, a magnetic field is created, a direction of the magnetic field being changed based on the direction of power supplied to the solenoid coil 136. Magnetic force generated by the solenoid coil 136 may be stronger than magnetic force generated by the permanent magnet 135, thereby serving to move the moving core 137.

Figure 11:
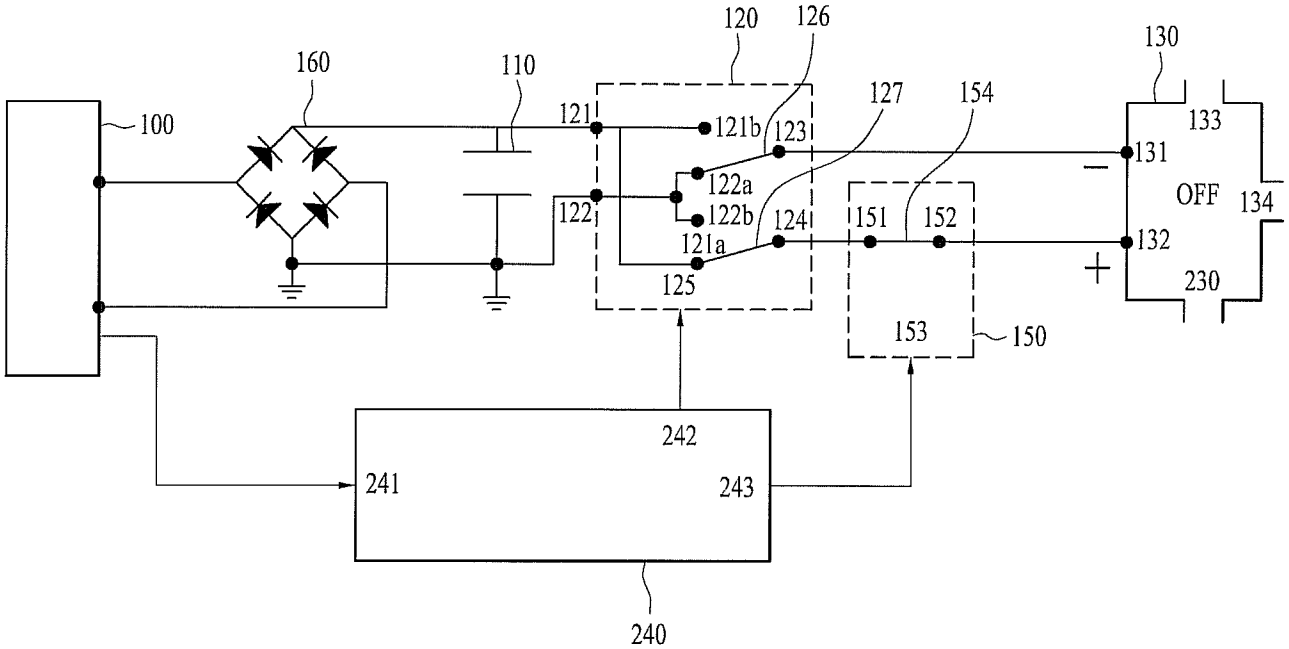
FIGS. 11 to 13 are circuit diagrams that illustrate an operation of a controller for a solenoid valve according to one embodiment of the present disclosure.
Figure 12:
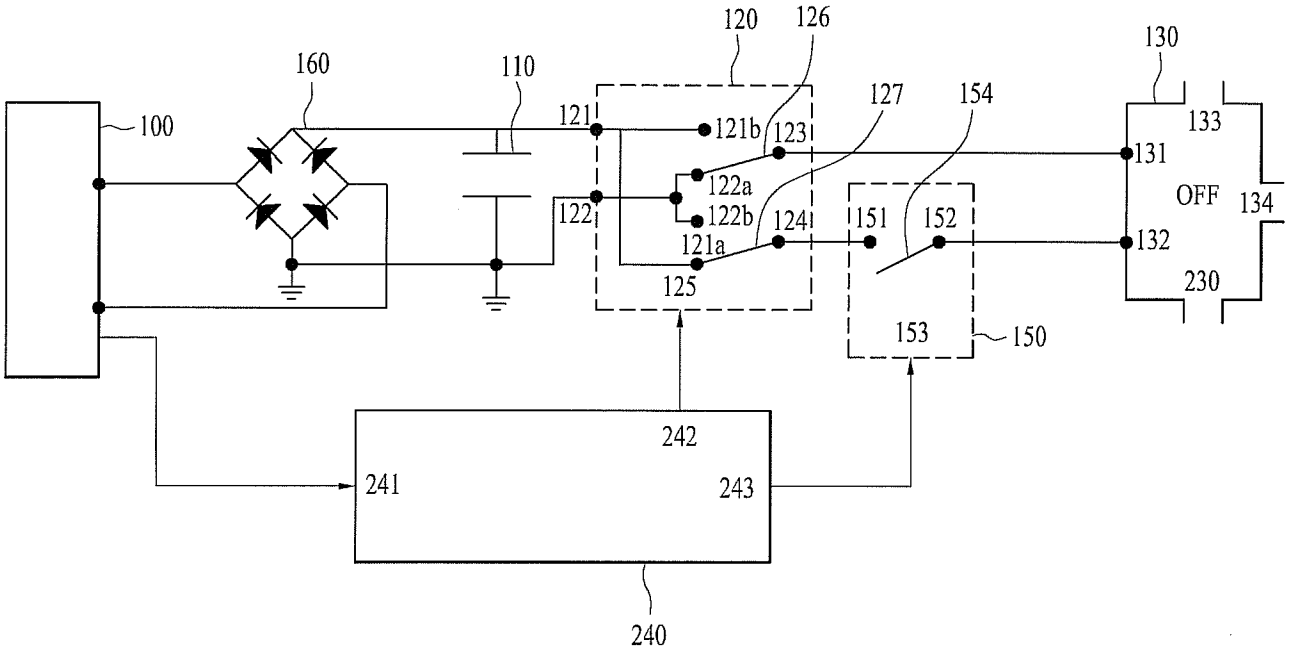
Figure 13:
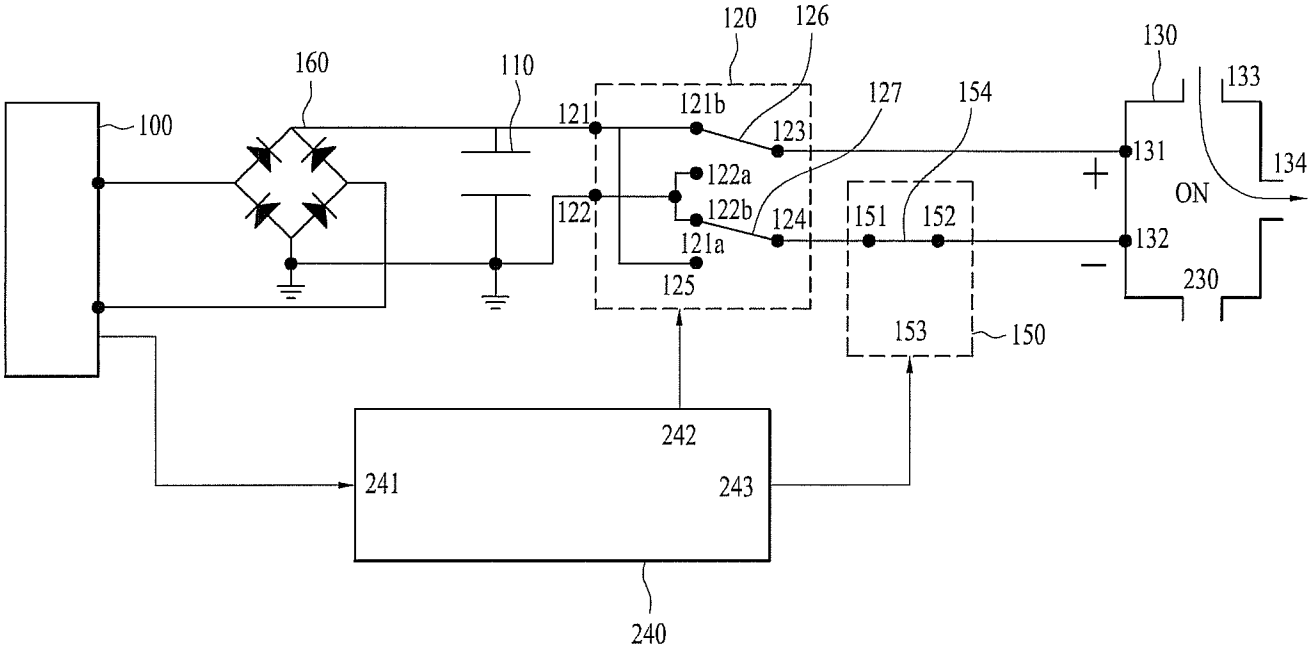

As described above, whether the solenoid valve 130 according to the present disclosure is closed or opened depends on a power input direction. Referring to FIG. 11, when a negative charge is input to the first power input part 131 and positive charge is input to the second power input part 132, the solenoid valve 130 may be closed. On the contrary, as illustrated in FIG. 13, when a positive charge is input to the first power input part 131 and negative charge is input to the second power input part 132, the solenoid valve 130 may be opened. FIG. 12 illustrates a state in which power is not applied after the solenoid valve 130 has been closed. The solenoid valve 130 may be held closed so long as power is not applied.

To open or close the solenoid valve 130, it may be necessary to change the direction of power to be input to the first power input part 131 and the second power input part 132. The power direction switching circuit 120 may be located between the external power supply unit 100 and the solenoid valve 130 and may serve to change the direction of power to be input to the solenoid valve 130.

The power direction switching circuit 120 may receive external power supplied to the refrigerator or power discharged from the capacitor 110, and may output the received power in a first direction or a second direction (polarities). If a signal that commands output of the power in the first direction or the second direction is input to the power direction switching circuit 120, a connection mode of the power direction switching circuit 120 may be changed in response to the signal, causing the direction of current (and polarity of voltage) to be changed.

The power direction switching circuit 120 may include a relay, which changes a circuit connection mode using an electromagnet to control flow of current. In the present disclosure, as shown in FIG. 10, the power direction switching circuit 120 may include the pair of terminals 121 and 122 connected to the capacitor 110, the pair of terminals 123 and 124 connected to the solenoid valve 130, and the signal input part 125.

The power direction switching circuit 120 may be connected to the microcomputer 240 such that the direction of power output from the power direction switching circuit 120 is changed under control of the microcomputer 240. As the signal input part 125 of the power direction switching circuit 120 is connected to the microcomputer 240, the microcomputer 240 may serve to input a signal to the signal input part 125.

FIGS. 11 to 13 show the power direction switching circuit 120 according to another embodiment of the present disclosure. The external power may be applied such that the first terminal 121 is positive and the second terminal 122 is negative. Here, a first direction refers to a power output direction in which the third terminal 123 is negative and the fourth terminal 124 is positive (reversed polarity), and the second direction refers to a power output direction in which the third terminal 123 is positive and the fourth terminal 124 is negative (input voltage and output voltage has the same polarity).

The first direction and the second direction may be inversely determined based on the connection mode of the solenoid valve 130.

The power direction switching circuit 120 of the present disclosure may allow current to flow in the first direction if the microcomputer 240 inputs a signal to the signal input part 125, and allows current to flow in the second direction if no signal is input.

FIG. 11 shows the power direction switching circuit 120 in a state in which current flows in the first direction, and FIG. 13 shows the power direction switching circuit 120 in a state in which current flows in the second direction.

More specifically, FIG. 11 shows an operating state when external power begins to be supplied. First, if external power is supplied to the refrigerator, the external power is input through the first terminal 121 and the second terminal 122. In this case, the external power may be AC, the power may be changed into DC by the rectifier 160 prior to being input to the first and second terminals 121 and 122.

The signal input part 125 may receive a signal from the microcomputer 240. The microcomputer 240 may monitor whether or not external power is supplied from the external power supply unit 100, and may input a signal to the signal input part 125 if external power is supplied to the refrigerator. The switches 126 and 127 of the power direction switching circuit 120 may be closed or opened in response to the signal input to the signal input part 125.

As one example of the power direction switching circuit 120, a switch coil may be provided adjacent to the switches 126 and 127. In this case, as current is applied to the switch coil to create a magnetic field, positions of the switches 126 and 127 may be changed. If a signal is input to the signal input unit 125, current is applied to the switch coil, causing positions of the switches 126 and 127 to be changed. In this way, a connection mode of the power direction switching circuit 120 is changed.

In the present disclosure, as current is applied to the switch coil in response to the signal input to the signal input unit 125, as illustrated in FIG. 11, positions of the switches 126 and 127 may be changed such that the first terminal 121*a* and the fourth terminal 124 are connected to each other and the second terminal 122*a* and the third terminal 123 are connected to each other. Accordingly, while external power is not supplied, power is supplied to the solenoid valve 130 in the first direction, causing the solenoid valve 130 to be closed.

On the contrary, the microcomputer 240 does not apply a signal to the signal input unit 125 if external power is not supplied from the external power supply unit 100. If there is no signal, as shown in FIG. 13, positions of the switches 126 and 127 are changed such that the first terminal 121*b* and the third terminal 123 are connected to each other and the second terminal 122*b* and the fourth terminal 124 are connected to each other. Accordingly, while external power is not supplied, power may be supplied to the solenoid valve 130 in the second direction, causing the solenoid valve 130 to be opened.

As described above, the microcomputer 240 may be connected to the signal input part 125 of the power direction switching circuit 120. If external power is supplied thereto, the microcomputer 240 applies a signal to the signal input unit 125. As the power is applied to the switch coil in response to the signal, the switches 126 and 127 may be moved to positions as shown in FIG. 11, causing power to be supplied to the solenoid valve 130 in the first direction.

On the contrary, while external power is not supplied, the microcomputer 240 does not apply the signal to the signal input part 125. As power is not applied to the switch coil, the switches 126 and 127 may be moved to positions as shown in FIG. 13, causing power to be supplied to the solenoid valve 130 in the second direction.

The power cutoff circuit 150 may disconnect an electrical connection (e.g., an electric wire) that supplies power to the solenoid valve 130 to interrupt power supplied to the solenoid valve 130. The power cutoff circuit 150 may be located at any position between the external power supply unit 100 and the solenoid valve 130 or between the external power supply unit 100 and the power direction switching circuit 120. Alternatively, as shown in FIG. 10, the power cutoff circuit 150 may be interposed between the power direction switching circuit 120 and the solenoid valve 130.

Hereinafter, for convenience of description, the case in which the power cutoff circuit 150 is interposed between the power direction switching circuit 120 and the solenoid valve 130 will be described, but the present disclosure is not limited thereto.

The power direction switching circuit 120 and the solenoid valve 130 may be connected to each other or disconnected from each other. This connection or disconnection of the power direction switching circuit 120 is determined based on whether or not a signal is input to the signal input part 153.

If a signal is input to the signal input part 153, the switch 154 may disconnect the first terminal 151 and the second terminal 152 from each other, thereby disconnecting the power direction switching circuit 120 and the solenoid valve 130 from each other. This state in which the power cutoff circuit 150 is referred to as being switched on is shown in FIG. 12.

The power direction switching circuit 120 may use a switch coil to change a position of the switch 154. If the microcomputer 240 inputs the signal to the signal input part 153, current is applied to the switch coil, causing the switch 154 to be opened as shown in FIG. 12.

On the contrary, if no signal is input to the signal input part 153, current is not applied to the switch coil, causing the switch 154 to be closed as shown in FIGS. 11 and 13. In this way, the solenoid valve 130 and the power direction switching circuit 120 are connected to each other.

After the solenoid valve 130 has been changed to an open state or a closed state, solenoid valve 130 may be held closed or open even if power is no longer supplied. Therefore, the microcomputer 240 may apply a signal to the power cutoff circuit 150 such that power is no longer supplied to the solenoid valve 130. Interrupting power may reduce energy consumption and prevent overheating of the solenoid valve 130.

When external power is continuously supplied until the solenoid valve 130 is closed, the solenoid valve 130 has a risk of overheating because of external power supplied to the solenoid valve 130. Thus, as shown in FIG. 12, it may be necessary to interrupt power supplied to the solenoid valve 130 using the power cutoff circuit 150.

However, in case of power outage, power of the capacitor 110 is supplied to the solenoid valve 130. Since the capacitor 110 has a limited capacitance, power is no longer supplied to the solenoid valve 130 after a predetermined time has passed. Thus, even if the switch 154 of the power cutoff circuit 150 is held closed as shown in FIG. 13, it has no negative effect on the solenoid valve 130.

The power cutoff circuit 150 may also be controlled by the microcomputer 240. The microcomputer 240 may apply a signal to the power cutoff circuit 150 to switch on the power cutoff circuit 150 after the solenoid valve 130 has been closed, thereby interrupting power to be applied to the solenoid valve 130.

More specifically, after a sufficient amount of time to complete operation to open or close the solenoid valve 130 has passed after supply of power from the external power supply unit 100 has begun, a signal may be input to the signal input unit 153, causing the power cutoff circuit 150 to interrupt power to be applied to the solenoid valve 130 (to switch on the power cutoff circuit 150).

Figure 14:
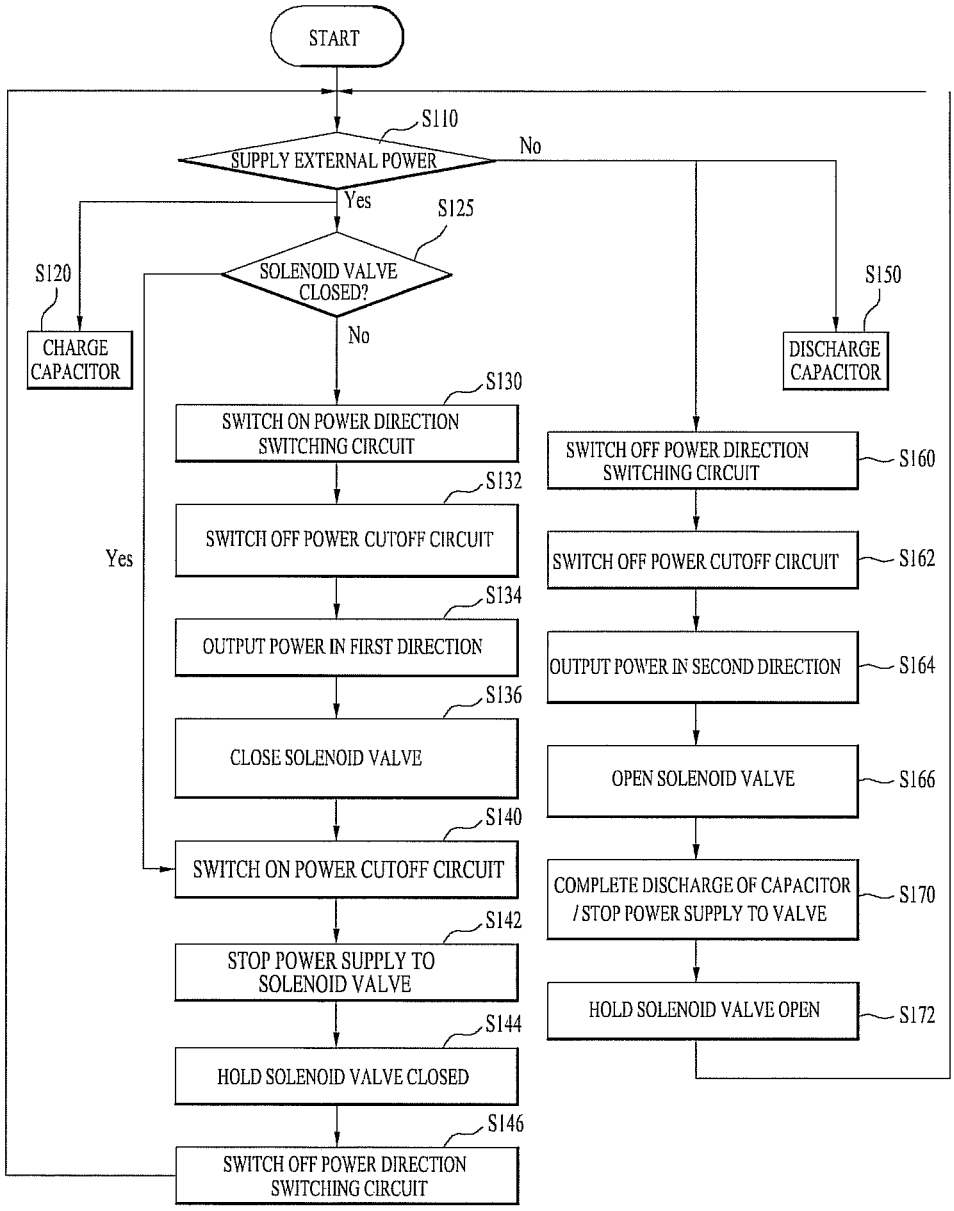
FIG. 14 is a flowchart of a method of controlling a solenoid valve according to one embodiment of the present disclosure.

FIG. 14 is a flowchart of a method for controlling a solenoid valve of FIGS. 11 to 13 according to another embodiment of the present disclosure. Based on whether or not external power is supplied, the microcomputer 240 may control the direction of power to be applied to the solenoid valve 130 and whether or not to apply the power.

First, it may be judged whether or not external power is supplied (S110). If it is judged that external power is supplied, a first operating procedure including charging the capacitor 110 with the external power, and supplying the external power to the solenoid valve 130 in the first direction to close the solenoid valve 130 (S120 to S146) may be performed.

If it is judged that external power is not supplied, a second operating procedure including discharging power from the capacitor 110, and supplying the power to the solenoid valve 130 in the second direction to open the solenoid valve 130 (S150 to S172) may be performed.

That is, the first operating procedure relates to the control method of the solenoid valve 130 when external power is supplied, and the second operating procedure relates to the control method of the solenoid valve 130 when external power is not supplied.

First, the first operating procedure when external power is supplied will be described. If it is determined that external power is being supplied (S110), the capacitor 110 may be charged using the external power (S120), and it may be judged whether or not the solenoid valve 130 is held closed. The solenoid valve 130, as described above, is held closed or open even if power is not supplied so long as an opposite direction of power is not applied. Thus, it is unnecessary to apply power to the closed solenoid valve.

Whether or not the solenoid valve is closed may be judged using a sensor that can directly sense a closed state of the solenoid valve 130. Alternatively, the operated state of the solenoid valve 130 may be judged using variables. For example, a variable having the value of 1 may be input when the solenoid valve 130 performs an opening operation, and a variable having the value of 0 may be input when the solenoid valve performs a closing operation.

One example of a method of inputting the value of 1 or 0 to the variable is as follows. If a predetermined amount of time has passed after application of operating power to the power direction switching circuit 120, it is judged that the solenoid valve 130 is completely closed, and the value of 1 is input to the variable. If external power is not applied, and thus operating power is not applied to the power direction switching circuit 120 in the second operating procedure, the value of 0 is input to the variable.

When external power begins to be supplied in case of power outage, it may be necessary to close the solenoid valve 130 that has been held open.

The operating power may be applied to the power direction switching circuit 120 to move the switches 126 and 127 of the power direction switching circuit 120 to the positions as shown in FIG. 11 (S130). The operating power may be supplied when the microcomputer 240 applies an operating signal to the signal input part 125. The operating signal applied by the microcomputer 240 may correspond to the operating power.

In this case, the microcomputer 240 does not apply the signal to the power cutoff circuit 150 to hold the power cutoff circuit 150 in an off state (S132). In the off state of the power cutoff circuit 150, as shown in FIG. 11, the power direction switching circuit 120 and the solenoid valve 130 may be connected to each other, and power is supplied to the solenoid valve 130.

In a state in which the power direction switching circuit 120 is in an on state and the power cutoff circuit 150 is in an off state, power is output in the first direction (S134), and the solenoid valve 130 is closed (S136).

After the solenoid valve 130 has been closed, a signal may be applied to the power cutoff circuit 150 to switch on the power cutoff circuit 150 under control of the microcomputer (S140). The switch 154 of the power cutoff circuit 150, as shown in FIG. 12, may be opened to interrupt power to be applied to the solenoid valve 130 (S142). After the solenoid valve 130 has been closed, the solenoid valve 130 may be held closed even if power is no longer supplied to the solenoid valve 130 (S144).

Since power is no longer supplied to the solenoid valve 130 by the power cutoff circuit 150, whether the power direction switching circuit 120 is in an on state or an off state has no effect on the state of the solenoid valve 130. Thus, the operating power to be applied to the solenoid valve 130 may be interrupted to switch off the power direction switching circuit 120 (S146). Interrupting the operating power to be supplied to the power direction switching circuit 120 may minimize energy consumption.

If the solenoid valve 130 is determined to be closed, in step S125, power is not supplied to the solenoid valve 130 until external power is no longer supplied (S142), thereby allowing the solenoid valve 130 to be held closed (S144). Accordingly, the power cutoff circuit 150 is held in an on state (S140), and the power direction switching circuit 120 is held in an off state (S146).

Next, the second operating procedure while power is not supplied will be described. Since external power to operate the solenoid valve 130 is not supplied in case of power outage, the capacitor 110 discharges power to supply the power to the solenoid valve 130 (S150).

In a state in which no signal is applied to the power direction switching circuit 120 and the power direction switching circuit 120 is in an off state (S160), the power direction switching circuit 120 may output power in the second direction as shown in FIG. 13 (S164). In this case, the power cutoff circuit 150 may be in an off state (S162) such that power is applied to the solenoid valve 130 in the second direction.

The solenoid valve 130 may be opened by the power applied in the second direction (S166). The discharge of the capacitor 110 may be completed after a predetermined amount of time has passed, and power may be no longer supplied to the solenoid valve 130 (S170). The capacitor 110 may store a predetermined amount of electric charge required to open the solenoid valve 130. For example, the capacitor 110 having a capacitance capable of supplying power to the solenoid valve 130 for a time of about 0.1 to 5 seconds may be used.

Even if the power is no longer supplied to the solenoid valve 130 by the capacitor 110, external power may again be supplied to the solenoid valve 130, allowing the solenoid valve 130 to be held open until power is supplied in the first direction.

As is apparent from the above description, a controller for a solenoid valve according to the present disclosure may actuate a solenoid valve provided in a refrigerator having no microcomputer even in case of power outage such that the solenoid valve is opened for preservation of cold air in a refrigeration compartment, which may prevent spoilage of food stored in the refrigeration compartment even if power outage occurs.

Moreover, the controller according to the present disclosure may be used even in a refrigerator having a microcomputer to actuate a solenoid valve that must be opened for preservation of cold air in the refrigeration compartment, thereby preventing spoilage of food stored in the refrigeration compartment. Furthermore, it may be unnecessary to continuously supply power to hold the solenoid valve closed or open, which may result in lower power consumption and prevent overheating of the solenoid valve.

As broadly described and embodied herein, a refrigerator may include a body having a freezing chamber and a refrigeration chamber, a cooling circuit for cooling the freezing chamber and the refrigeration chamber, a power source for supplying power to the cooling circuit, a thermosyphon provided between the freezing chamber and refrigerating chamber, and a control circuit connected to the thermosyphon to control a flow of refrigerant in the thermosyphon. The control circuit may include a valve provided on a circulation path of the thermosyphon, an electrical power storage device connected between the power source and the valve, and a switching circuit provided between the valve and the electrical power storage device. When the power source does not supply power to the cooling circuit, the control circuit operates the thermosyphon using power stored in the electrical power storage device.

The electrical power storage device may be a battery. The electrical power storage device may be a capacitor. The refrigerator may further include a microcomputer to control the direction of power output of the power direction switching circuit based on whether or not external power is supplied. The control circuit may include a power cutoff circuit to electrically disconnect the switching circuit and the valve from each other after the valve has been operated, and wherein the power cutoff circuit is controlled by the microcomputer. The microcomputer may control the switching circuit to provide a voltage having a first polarity to the valve if the power source is operational, and wherein the microcomputer controls the capacitor to supply a second voltage to the valve and controls the switching circuit to provide the second voltage at a second polarity to the valve if the power source is not operational. The capacitor may be configured to discharge for 0.1 to 5 seconds.

The control circuit may include a time delay circuit configured to receive power from the power source and to delay an output of the power source for a prescribed amount of time, and a power cutoff circuit to receive the output from the time delay circuit, the power cutoff circuit configured to electrically disconnect the switching circuit and the valve from each other in response to the output from the time delay circuit. The time delay circuit may delay the power received from the power source to the power cutoff circuit by 0.1 to 5 seconds. The capacitor may be configured to discharge for a greater amount of time than the amount delayed by the time delay circuit. A converter may be provided to rectify an output of the power source into a Direct Current (DC) signal for supply to the capacitor and the switching circuit.

The valve may be provided on the circulation path of the thermosyphon is a solenoid valve. The valve may include an inlet port, an outlet port, and an injection port. The valve includes an inlet port for receiving the refrigerant into the valve and an outlet port for discharging the refrigerant from the valve, a core movably provided to open or close the outlet port, and a solenoid coil to move the core. The valve may include an injection pipe configured to receive the refrigerant into the thermosyphon. The core may include a case formed of a ferromagnetic material. A first protrusion and a second protrusion may be provided at distal ends of the case and positioned opposite to each other. The first protrusion and the second protrusions may be plugs, and a spring may be provided in the case to support the first and second plugs against the case. The core may be moved to selectively seal the outlet with the first plug or seal the injection pipe with the second plug.

In one embodiment, a refrigerator may include a body having a freezing chamber and a refrigeration chamber, a cooling circuit for cooling the freezing chamber and the refrigeration chamber, a power source for supplying power to the cooling circuit, a thermosyphon provided between the freezing chamber and refrigerating chamber, and a control circuit connected to the thermosyphon to control a flow of refrigerant in the thermosyphon. The control circuit may include a valve provided on a circulation path of the thermosyphon, a capacitor connected between the power source and the valve, and a switching circuit provided between the valve and the electrical power storage device. The capacitor may be configured to be charged by the power source when the power source is operational and to discharge when the power source is not operational, the switching circuit may be configured to receive power from the power source or the capacitor, and to output power having a first polarity when the power source is operational and output power having a second polarity when the power source is not operational, and the valve may be configured to close a flow path for the refrigerant when the output power has the first polarity and to open the flow path when the output power has the second polarity.

The valve may be a solenoid valve, and may be installed on a circulation path of a thermosyphon of the refrigerator. A power application device may be provided to control an electrical connection between the switching circuit and the valve, wherein the valve is a latch valve that holds a previous open or closed state when an output of the power application device stops. A power cutoff circuit may be provided to electrically connect or disconnect the switching circuit and the valve, wherein the valve is a latch type solenoid valve that holds a previous open or closed state when an output of the power supply stops.

In one embodiment, a refrigerator may include a body having a freezing chamber and a refrigeration chamber, a cooling circuit for cooling the freezing chamber and the refrigeration chamber, a power source for supplying power to the cooling circuit, a thermosyphon provided between the freezing chamber and refrigerating chamber, an injection port to inject refrigerant into the thermosyphon, and a control circuit connected to the thermosyphon to control a flow of refrigerant in the thermosyphon, the control circuit including a valve provided on a circulation path of the thermosyphon, an electrical power storage device connected between the power source and the valve, and a switching circuit provided between the valve and the electrical power storage device, wherein, when the power source does not supply power to the cooling circuit, the control circuit operates the thermosyphon using power stored in the electrical power storage device. The injection port may be provided on the valve.

In one embodiment, a controller for a solenoid valve may include a capacitor, which is charged when external power is supplied to a refrigerator and is discharged when external power is not supplied, a power direction switching circuit, to which external power supplied to the refrigerator or power discharged from the capacitor is selectively input, the power direction switching circuit outputting power in a first direction or a second direction, and a solenoid valve, which receives power output from the power direction switching circuit and is operated to close a flow path if the power is applied in the first direction and to open the flow path if the power is applied in the second direction.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a body having a freezing chamber and a refrigeration chamber, wherein the refrigeration chamber is below the freezing chamber;

a cooling circuit for cooling the freezing chamber and the refrigeration chamber when power is received;

a power source for supplying power to the cooling circuit;

a thermosyphon provided between the freezing chamber and the refrigerating chamber to circulate refrigerant between the freezing chamber and the refrigeration chamber when power is not received;

the thermosyphon having a condensing portion located in the freezing chamber, an evaporating portion located in the refrigeration chamber, and connecting pipes connecting the condensing portion with the evaporating portion, wherein the condensing portion has an inlet and an outlet connected to the connecting pipes and the evaporating portion has an inlet and an outlet connected to the connecting pipes such that the condensing portion, the connecting pipes and the evaporating portion are connected to each other to form a loop that extends from the freezing chamber to the refrigerating chamber;

a valve provided on a circulation path of the thermosyphon; and a control circuit connected to the valve to control a flow of refrigerant in the thermosyphon, the control circuit including an electrical power storage device connected between the power source and the valve, the electrical power storage device having a capacitor charged with the external power, and a power direction switching circuit provided between the valve and the electrical power storage device, wherein the power direction switching circuit is configured to change a direction of power to be input to the valve to open or close the valve, wherein the control circuit opens the valve and the refrigerant circulates in the thermosyphon when the external power is not supplied, wherein the control circuit closes the valve and the refrigerant does not circulate in the thermosyphon when the external power is supplied, wherein the capacitor is configured to store a prescribed energy to open the valve, and in a case the control circuit opens the valve and the refrigerant circulates in the thermosyphon when the external power is not supplied, the valve is maintained to be open after the capacitor has completed discharge of the prescribed energy, and wherein the valve for the thermosyphon includes:

a body having a space formed inside the body;

an inlet port provided on a first side of the body and in communication with the space for receiving the refrigerant into the valve;

an outlet port provided on a second side of the body and in communication with the space for discharging the refrigerant from the valve;

a core movably provided in the space to open or close the outlet port, the core having a case to accommodate an elastic member coupled to a protruding piece that mates with the outlet port to stop flow of refrigerant of the thermosyphon, wherein when the core is positioned at a first position, the protruding piece is moved away from the outlet port to allow refrigerant in the thermosyphon to flow from the inlet port to the outlet port, and when the core is positioned at a second position, the protruding piece is coupled with the outlet port to stop flow of refrigerant in the thermosyphon; and a solenoid coil to move the core, wherein when the prescribed energy is applied to the solenoid coil to move the core, the core is moved and maintained at the first position or the second position by magnetic force without additional power.

2. The refrigerator according to claim 1, wherein the valve is configured to close the circulation path when the power direction switch circuit outputs the power in the first direction of power and to open the circulation path when the power direction switch circuit outputs the power in the second direction of power.

3. The refrigerator according to claim 1, wherein the valve includes an injection port to receive the refrigerant into the thermosyphon.

4. The refrigerator according to claim 1, wherein the power direction switching circuit is connected to the power source to receive power from the power source when the power source is operational and connected to the power storage device to receive power from the power storage device when the power source is not operational, and wherein the power direction switching circuit outputs the power in a first direction of power when the power source is operational and outputs the power in a second direction of power when the power source is not operational.

5. The refrigerator according to claim 4, wherein the control circuit includes a power cutoff circuit to electrically disconnect the power source and/or the power storage device from the valve and to electrically connect the power source and/or the power storage device to the valve.

6. The refrigerator according to claim 5, wherein the connection or the disconnection is determined based on whether or not a control signal is input to a signal input part of the power cutoff circuit, and wherein the power cutoff circuit interrupts the power such that the power is no longer supplied after a closed or open state of valve has been changed.

7. The refrigerator according to claim 5, wherein the power cutoff circuit is interposed between the power direction switching circuit and the valve.

8. The refrigerator according to claim 5, wherein the control circuit includes a time delay circuit configured to sense that the power source is available and unavailable, and generate a control signal after an amount of time after sensing, thereby switching on the power cutoff circuit to interrupts the power to the valve.

9. The refrigerator according to claim 5, wherein the control circuit includes a time delay circuit configured to generate a control signal in an amount of time after the state of valve has been changed, thereby switching on the power cutoff circuit to interrupts the power to the valve.

10. The refrigerator according to claim 4, wherein the control circuit includes:

a time delay circuit configured to receive power from the power source and to outputs the power after an amount of time for the valve to fully close or open; and a power cutoff circuit to receive the output from the time delay circuit, the power cutoff circuit configured to electrically disconnect the power source and/or the power storage device and the valve from each other in response to the output from the time delay circuit.

11. The refrigerator according to claim 4, further comprising a power application device that controls an electrical connection between the power direction switching circuit and the valve.

12. The refrigerator according to claim 11, wherein the valve holds a current open or closed state when an output of the power application device stops.

13. The refrigerator according to claim 4, further comprising a microcomputer to control the direction of power output from the power direction switching based on whether or not the power source is available.

14. The refrigerator according to claim 13, wherein the control circuit includes a power cutoff circuit to disconnect the power direction switching circuit and the valve from each other after the valve has been operated, and wherein the power cutoff is controlled by the microcomputer.

15. The refrigerator according to claim 13, wherein the microcomputer controls the power direction switching circuit to provide a voltage having a first polarity to the valve from the power source if the power source is operational, and wherein the microcomputer controls the switching circuit to provide a voltage having a second polarity to the valve from the electrical power storage device.

16. The refrigerator according to claim 4, wherein the cooling circuit separate from the thermosyphon and includes an evaporator, compressor, condenser, and an expander.

17. The refrigerator according to claim 4, wherein, when the valve is opened while power is not received, the refrigerant in the thermosyphon circulates in a closed system according to differences in pressure without being dependent on external power.

18. A control method of a refrigerator including a freezing chamber, a refrigeration chamber located below the freezing chamber, a cooling circuit, a thermosyphon, the thermosyphon having a condensing portion located in the freezing chamber, evaporating portion located in the refrigeration chamber, and a connecting pipe connecting the condensing portion with the evaporating portion, a solenoid valve for the thermosyphon and a controller for the solenoid valve, wherein the condensing portion has an inlet and an outlet connected to the connecting pipes and the evaporating portion has an inlet and an outlet connected to the connecting pipes such that the condensing portion, the connecting pipes and the evaporating portion are connected to each other to form a loop that extends from the freezing chamber to the refrigerating chamber, comprising:

performing a first operating procedure when the external power is supplied, the first operating procedure including operating the cooling circuit, charging a capacitor with the external power and supplying the external power to the solenoid valve in a first polarity to close the solenoid valve not to circulate a refrigerant in the thermosyphon; and performing a second operating procedure when the external power is not supplied, the second operating procedure including discharging power from the capacitor and supplying the power to the solenoid valve in a second polarity to open the solenoid valve to circulate the refrigerant around the loop in the thermosyphon, wherein the capacitor is configured to store a prescribed energy to open the solenoid valve, and in a case the solenoid valve is opened in the second operating procedure to circulate refrigerant in the thermosyphon when the external power is not supplied, the solenoid valve is maintained to be open after the capacitor has completed discharge of the prescribed energy, and wherein the solenoid valve for the thermosyphon includes:

a body having a space formed inside the body;

an inlet port provided on a first side of the body and in communication with the space for receiving the refrigerant into the valve;

an outlet port provided on a second side of the body and in communication with the space for discharging the refrigerant from the solenoid valve;

a core movably provided in the space to open or close the outlet port, the core having a case to accommodate an elastic member coupled to a protruding piece that mates with the outlet port to stop flow of refrigerant of the thermosyphon, wherein when the core is positioned at a first position, the protruding piece is moved away from the outlet port to allow refrigerant in the thermosyphon to flow from the inlet port to the outlet port, and when the core is positioned at a second position, the protruding piece is coupled with the outlet port to stop flow of refrigerant in the thermosyphon; and a solenoid coil to move the core, wherein when the prescribed energy is applied to the solenoid coil to move the core, the core is moved and maintained at the first position or the second position by magnetic force without additional power.

19. The control method according to claim 18, wherein a power direction switching circuit is switched on to supply the external power to the solenoid valve in the first polarity to close the solenoid valve and is switched off to supply the power from the capacitor to the solenoid valve in the second polarity to open the solenoid valve.

20. The control method according to claim 19, further comprising applying the external power to a time delay circuit, the time delay circuit output the power after a predetermined time has passed.

21. The control method according to claim 20, further comprising switching on a power cutoff circuit after the predetermined time has passed to stop the power supplying to the solenoid valve.

22. The control method according to claim 19, further comprising judging whether or not the external power is supplied prior to performing the first operating procedure and the second operating procedure.

23. The control method according to claim 22, further comprising judging whether or not the solenoid valve is closed using a sensor or variables, when the external power is supplied.

24. The control method according to claim 18, wherein the solenoid valve is held closed or open even if power is not supplied to the solenoid valve so long as an opposite polarity of power is not applied.

25. The control method according to claim 24, further comprising switching off the power direction switching circuit after the valve is held closed.

* * * * *